US009569932B2

(12) United States Patent
Nicely et al.

(10) Patent No.: US 9,569,932 B2
(45) Date of Patent: Feb. 14, 2017

(54) CENTRAL DETERMINATION GAMING SYSTEM AND METHOD FOR PROVIDING A PERSISTENCE GAME WITH PREDETERMINED GAME OUTCOMES

(75) Inventors: Mark C. Nicely, Daly City, CA (US); Bryan D. Wolf, Reno, NV (US)

(73) Assignee: IGT, Las Vegas, NV (US)

( * ) Notice: Subject to any disclaimer, the term of this patent is extended or adjusted under 35 U.S.C. 154(b) by 1396 days.

(21) Appl. No.: 12/496,921

(22) Filed: Jul. 2, 2009

(65) Prior Publication Data

US 2011/0003627 A1 Jan. 6, 2011

(51) Int. Cl.
*A63F 9/24* (2006.01)
*G07F 17/32* (2006.01)

(52) U.S. Cl.
CPC ..... *G07F 17/3267* (2013.01); *G07F 17/3244* (2013.01)

(58) Field of Classification Search
CPC ... G07F 17/32; G07F 17/3225; G07F 17/3258
USPC ..... 463/16, 25–28, 42, 43
See application file for complete search history.

(56) References Cited

U.S. PATENT DOCUMENTS 4,157,829 A 6/1979 Goldman et al.
4,332,389 A 6/1982 Loyd et al.
4,335,809 A 6/1982 Wain
4,339,798 A 7/1982 Hedges et al.
4,365,810 A 12/1982 Richardson
4,373,726 A 2/1983 Churchill et al.
4,448,419 A 5/1984 Telnaes
4,455,025 A 6/1984 Itkis
4,467,424 A 8/1984 Hedges et al.
4,494,197 A 1/1985 Troy et al.
4,527,798 A 7/1985 Siekierski et al.
4,582,324 A 4/1986 Koza et al.
4,624,462 A 11/1986 Itkis
4,636,951 A 1/1987 Harlick
4,652,998 A 3/1987 Koza et al.
4,669,730 A 6/1987 Small
(Continued)

FOREIGN PATENT DOCUMENTS

GB 2 090 690 7/1982
GB 2 170 636 8/1986
(Continued)

*Primary Examiner* — Werner Garner
*Assistant Examiner* — Robert Mosser
(74) *Attorney, Agent, or Firm* — Neal, Gerber & Eisenberg LLP

(57) ABSTRACT

A gaming system which provides a persistence game which utilizes predetermined game outcomes. One or more predetermined game outcomes include a persistence game award value. If a predetermined game outcome including such a persistence game award value is selected to be provided to the player in association with a current play of a primary game, the gaming system determines whether to provide this persistence game award value to a player in association with the current play of the primary game, or to store this persistence game award value to be subsequently provided to a player in association with a subsequent play of the primary game. The determination of whether to provide or store the persistence game award value is based on the then current progress of the persistence game (i.e., the current state of an accumulation meter).

27 Claims, 16 Drawing Sheets

(56) References Cited

U.S. PATENT DOCUMENTS

| | | | |
|---|---|---|---|
| 4,679,143 | A | 7/1987 | Hagiwara |
| 4,689,742 | A | 8/1987 | Troy et al. |
| 4,798,387 | A | 1/1989 | Richardson |
| 4,805,907 | A | 2/1989 | Hagiwara |
| 4,815,741 | A | 3/1989 | Small |
| 4,817,951 | A | 4/1989 | Crouch et al. |
| 4,842,278 | A | 6/1989 | Markowicz |
| 4,848,771 | A | 7/1989 | Richardson |
| 4,856,787 | A | 8/1989 | Itkis |
| 4,880,237 | A | 11/1989 | Kishishita |
| 4,882,473 | A | 11/1989 | Bergeron et al. |
| 4,982,337 | A | 1/1991 | Burr et al. |
| 5,007,649 | A | 4/1991 | Richardson |
| 5,042,809 | A | 8/1991 | Richardson |
| 5,092,598 | A | 3/1992 | Kamille |
| 5,100,139 | A | 3/1992 | Di Bella |
| 5,119,295 | A | 6/1992 | Kapur |
| 5,158,293 | A | 10/1992 | Mullins |
| 5,223,698 | A | 6/1993 | Kapur |
| 5,265,874 | A | 11/1993 | Dickinson et al. |
| 5,275,400 | A | 1/1994 | Weingardt et al. |
| 5,276,312 | A | 1/1994 | McCarthy |
| 5,282,620 | A | 2/1994 | Keesee |
| 5,297,802 | A | 3/1994 | Pocock et al. |
| 5,324,035 | A | 6/1994 | Morris et al. |
| 5,326,104 | A | 7/1994 | Pease et al. |
| 5,348,299 | A | 9/1994 | Clapper, Jr. |
| 5,351,970 | A | 10/1994 | Fioretti |
| 5,377,975 | A | 1/1995 | Clapper, Jr. |
| 5,393,061 | A | 2/1995 | Manship et al. |
| 5,398,932 | A | 3/1995 | Eberhardt et al. |
| 5,407,199 | A | 4/1995 | Gumina |
| 5,411,271 | A | 5/1995 | Mirando |
| 5,476,259 | A | 12/1995 | Weingardt |
| 5,487,544 | A | 1/1996 | Clapper, Jr. |
| 5,536,008 | A | 7/1996 | Clapper, Jr. |
| 5,542,669 | A | 8/1996 | Charron et al. |
| 5,562,284 | A | 10/1996 | Stevens |
| 5,564,701 | A | 10/1996 | Dettor |
| 5,570,885 | A | 11/1996 | Ornstein |
| 5,580,311 | A | 12/1996 | Haste, III |
| 5,586,937 | A | 12/1996 | Menashe |
| 5,595,538 | A | 1/1997 | Haste, III |
| 5,609,337 | A | 3/1997 | Clapper, Jr. |
| 5,628,684 | A | 5/1997 | Bouedec |
| 5,630,754 | A | 5/1997 | Rebane |
| 5,645,485 | A | 7/1997 | Clapper, Jr. |
| 5,657,899 | A | 8/1997 | Stoken |
| 5,674,128 | A | 10/1997 | Holch et al. |
| 5,697,843 | A | 12/1997 | Manship et al. |
| 5,720,483 | A | 2/1998 | Trinh |
| 5,735,432 | A | 4/1998 | Stoken et al. |
| 5,749,784 | A | 5/1998 | Clapper, Jr. |
| 5,779,545 | A | 7/1998 | Berg et al. |
| 5,779,547 | A | 7/1998 | SoRelle et al. |
| 5,800,269 | A | 9/1998 | Holch et al. |
| 5,810,664 | A | 9/1998 | Clapper, Jr. |
| 5,830,067 | A | 11/1998 | Graves et al. |
| 5,833,537 | A | 11/1998 | Barrie |
| 5,855,515 | A | 1/1999 | Pease et al. |
| 5,871,398 | A | 2/1999 | Schneier et al. |
| 5,876,283 | A | 3/1999 | Parra et al. |
| 5,882,260 | A | 3/1999 | Marks et al. |
| 5,915,588 | A | 6/1999 | Stoken et al. |
| 5,928,082 | A | 7/1999 | Clapper, Jr. |
| 5,941,771 | A | 8/1999 | Haste, III |
| 5,944,606 | A | 8/1999 | Gerow |
| 5,949,042 | A | 9/1999 | Dietz, II et al. |
| 5,954,582 | A | 9/1999 | Zach |
| 5,970,143 | A | 10/1999 | Schneier et al. |
| 5,980,385 | A | 11/1999 | Clapper, Jr. |
| 5,984,779 | A | 11/1999 | Bridgeman et al. |
| 5,996,997 | A | 12/1999 | Kamille |
| 6,012,984 | A | 1/2000 | Roseman |
| 6,017,032 | A | 1/2000 | Grippo et al. |
| 6,024,640 | A | 2/2000 | Walker et al. |
| 6,030,288 | A | 2/2000 | Davis et al. |
| 6,056,289 | A | 5/2000 | Clapper, Jr. |
| 6,062,981 | A | 5/2000 | Luciano, Jr. |
| 6,079,711 | A | 6/2000 | Wei et al. |
| 6,089,982 | A | 7/2000 | Holch et al. |
| 6,093,100 | A | 7/2000 | Singer et al. |
| 6,099,408 | A | 8/2000 | Schneier et al. |
| 6,117,009 | A | 9/2000 | Yoseloff |
| 6,120,024 | A | 9/2000 | Lind |
| 6,146,272 | A | 11/2000 | Walker et al. |
| 6,155,925 | A | 12/2000 | Giobbi et al. |
| 6,159,095 | A | 12/2000 | Frohm et al. |
| 6,168,521 | B1 | 1/2001 | Luciano et al. |
| 6,168,523 | B1 | 1/2001 | Piechowiak et al. |
| 6,174,233 | B1 | 1/2001 | Sunaga et al. |
| 6,183,361 | B1 | 2/2001 | Cummings et al. |
| 6,203,430 | B1 | 3/2001 | Walker et al. |
| 6,210,275 | B1 | 4/2001 | Olsen |
| 6,210,276 | B1 | 4/2001 | Mullins |
| 6,217,448 | B1 | 4/2001 | Olsen |
| 6,220,961 | B1 | 4/2001 | Keane et al. |
| 6,241,606 | B1 | 6/2001 | Riendeau et al. |
| 6,250,685 | B1 | 6/2001 | Walker et al. |
| 6,254,480 | B1 | 7/2001 | Zach |
| 6,273,820 | B1 | 8/2001 | Haste, III |
| 6,280,325 | B1 | 8/2001 | Fisk |
| 6,280,328 | B1 | 8/2001 | Holch et al. |
| 6,302,791 | B1 | 10/2001 | Frohm et al. |
| 6,306,038 | B1 | 10/2001 | Graves et al. |
| 6,309,298 | B1 | 10/2001 | Gerow |
| 6,315,289 | B1 | 11/2001 | Sakamoto et al. |
| 6,325,716 | B1 | 12/2001 | Walker et al. |
| 6,358,150 | B1 | 3/2002 | Mir et al. |
| 6,358,151 | B1 | 3/2002 | Enzminger et al. |
| 6,368,218 | B2 | 4/2002 | Angell, Jr. |
| 6,386,977 | B1 | 5/2002 | Hole |
| 6,402,614 | B1 | 6/2002 | Schneier et al. |
| 6,419,583 | B1 | 7/2002 | Crumby et al. |
| 6,443,837 | B1 | 9/2002 | Jaffe et al. |
| 6,447,395 | B1 | 9/2002 | Stevens |
| 6,450,885 | B2 | 9/2002 | Schneier et al. |
| 6,454,648 | B1 | 9/2002 | Kelly et al. |
| 6,454,649 | B1 | 9/2002 | Mattice et al. |
| RE37,885 | E | 10/2002 | Acres et al. |
| 6,471,591 | B1 | 10/2002 | Crumby |
| 6,475,086 | B2 | 11/2002 | Zach |
| 6,508,711 | B1 | 1/2003 | Ono |
| 6,524,184 | B1 | 2/2003 | Lind et al. |
| 6,524,185 | B2 | 2/2003 | Lind |
| 6,527,638 | B1 | 3/2003 | Walker et al. |
| 6,533,664 | B1 | 3/2003 | Crumby |
| 6,537,150 | B1 | 3/2003 | Luciano et al. |
| 6,569,017 | B2 | 5/2003 | Enzminger et al. |
| 6,599,187 | B2 | 7/2003 | Gerow |
| 6,607,438 | B2 | 8/2003 | Baerlocher et al. |
| 6,656,040 | B1 | 12/2003 | Brosnan et al. |
| 6,656,044 | B1 | 12/2003 | Lewis |
| 6,726,563 | B1 | 4/2004 | Baerlocher et al. |
| 6,729,961 | B1 | 5/2004 | Millerschone |
| 6,739,971 | B2 | 5/2004 | Devaull |
| 6,749,500 | B1 | 6/2004 | Nelson et al. |
| 6,749,510 | B2 | 6/2004 | Giobbi |
| 6,857,958 | B2 | 2/2005 | Osawa |
| 6,866,584 | B2 | 3/2005 | Michaelson |
| 6,988,946 | B2 | 1/2006 | Michaelson et al. |
| 7,056,214 | B2 | 6/2006 | Miereau et al. |
| 7,070,501 | B2 | 7/2006 | Cormack et al. |
| 7,192,348 | B2 | 3/2007 | Brosnan et al. |
| 7,291,069 | B2 | 11/2007 | Michaelson et al. |
| 7,329,183 | B2 | 2/2008 | Michaelson et al. |
| 7,399,227 | B2 | 7/2008 | Michaelson et al. |
| 7,416,484 | B1 | 8/2008 | Nelson et al. |
| 7,470,183 | B2 | 12/2008 | Wishart |
| 7,524,243 | B2 | 4/2009 | Bansemer et al. |
| 2002/0010013 | A1 | 1/2002 | Walker et al. |
| 2002/0039917 | A1 | 4/2002 | Armstrong et al. |
| 2002/0072404 | A1 | 6/2002 | Gerow |
| 2002/0077173 | A1 | 6/2002 | Luciano et al. |

(56) References Cited

U.S. PATENT DOCUMENTS

| | | | |
|---|---|---|---|
| 2002/0077174 | A1 | 6/2002 | Luciano et al. |
| 2002/0082070 | A1 | 6/2002 | Macke et al. |
| 2002/0082071 | A1 | 6/2002 | Riendeau et al. |
| 2002/0082085 | A1 | 6/2002 | Osterer |
| 2002/0090986 | A1 | 7/2002 | Cote et al. |
| 2002/0094871 | A1 | 7/2002 | Luciano et al. |
| 2002/0098882 | A1 | 7/2002 | Lind et al. |
| 2002/0098883 | A1 | 7/2002 | Packes, Jr. et al. |
| 2002/0111207 | A1 | 8/2002 | Lind et al. |
| 2002/0111214 | A1 | 8/2002 | Lind et al. |
| 2002/0113369 | A1 | 8/2002 | Weingardt |
| 2002/0132661 | A1 | 9/2002 | Lind et al. |
| 2002/0132666 | A1 | 9/2002 | Lind et al. |
| 2002/0155881 | A1 | 10/2002 | Yoshida |
| 2002/0169018 | A1 | 11/2002 | Schneier et al. |
| 2003/0100371 | A1 | 5/2003 | Gatto et al. |
| 2003/0100372 | A1 | 5/2003 | Gatto et al. |
| 2003/0125101 | A1 | 7/2003 | Campo |
| 2003/0181231 | A1 | 9/2003 | Vancura et al. |
| 2003/0193136 | A1 | 10/2003 | Walker et al. |
| 2003/0211879 | A1 | 11/2003 | Englman |
| 2003/0211884 | A1 | 11/2003 | Gauselmann |
| 2003/0236115 | A1 | 12/2003 | Chamberlain |
| 2004/0063489 | A1 | 4/2004 | Crumby |
| 2004/0116179 | A1 | 6/2004 | Nicely et al. |
| 2004/0224770 | A1 | 11/2004 | Wolf et al. |
| 2005/0003880 | A1 | 1/2005 | Englman et al. |
| 2005/0153769 | A1 | 7/2005 | Casey et al. |
| 2005/0159200 | A1 | 7/2005 | Nicely et al. |
| 2006/0052148 | A1 | 3/2006 | Blair, Jr. et al. |
| 2006/0079317 | A1 | 4/2006 | Flemming et al. |
| 2006/0154714 | A1 | 7/2006 | Montross et al. |
| 2006/0160620 | A1 | 7/2006 | Matthews et al. |
| 2006/0172791 | A1 | 8/2006 | Wolf |
| 2006/0189377 | A1 | 8/2006 | Gomez et al. |
| 2007/0032285 | A1 | 2/2007 | Wolf |
| 2007/0060297 | A1 | 3/2007 | Hein et al. |
| 2007/0077979 | A1 | 4/2007 | Cohn et al. |
| 2007/0117606 | A1* | 5/2007 | Baerlocher et al. ..... 463/16 |
| 2007/0135193 | A1 | 6/2007 | Nicely |
| 2008/0045302 | A1 | 2/2008 | Low |
| 2008/0070681 | A1 | 3/2008 | Marks et al. |
| 2008/0076531 | A1 | 3/2008 | Baerlocher et al. |
| 2008/0076532 | A1 | 3/2008 | Graham et al. |
| 2008/0076542 | A1 | 3/2008 | Iddings et al. |
| 2008/0108429 | A1 | 5/2008 | Davis et al. |
| 2008/0113714 | A1 | 5/2008 | Vallejo |
| 2008/0176649 | A1 | 7/2008 | Sakuma |
| 2008/0200244 | A1 | 8/2008 | Rowe et al. |
| 2009/0036202 | A1 | 2/2009 | Baerlocher et al. |
| 2009/0124335 | A1 | 5/2009 | Watkins et al. |

FOREIGN PATENT DOCUMENTS

| | | |
|---|---|---|
| GB | 2 183 882 | 6/1987 |
| GB | 2 262 642 | 6/1993 |
| GB | 2 353 128 | 2/2001 |
| WO | WO 98/35309 | 8/1998 |
| WO | WO 02/097749 | 12/2002 |
| WO | WO 2007/103054 | 9/2007 |
| WO | WO 2008/048634 | 4/2008 |

* cited by examiner

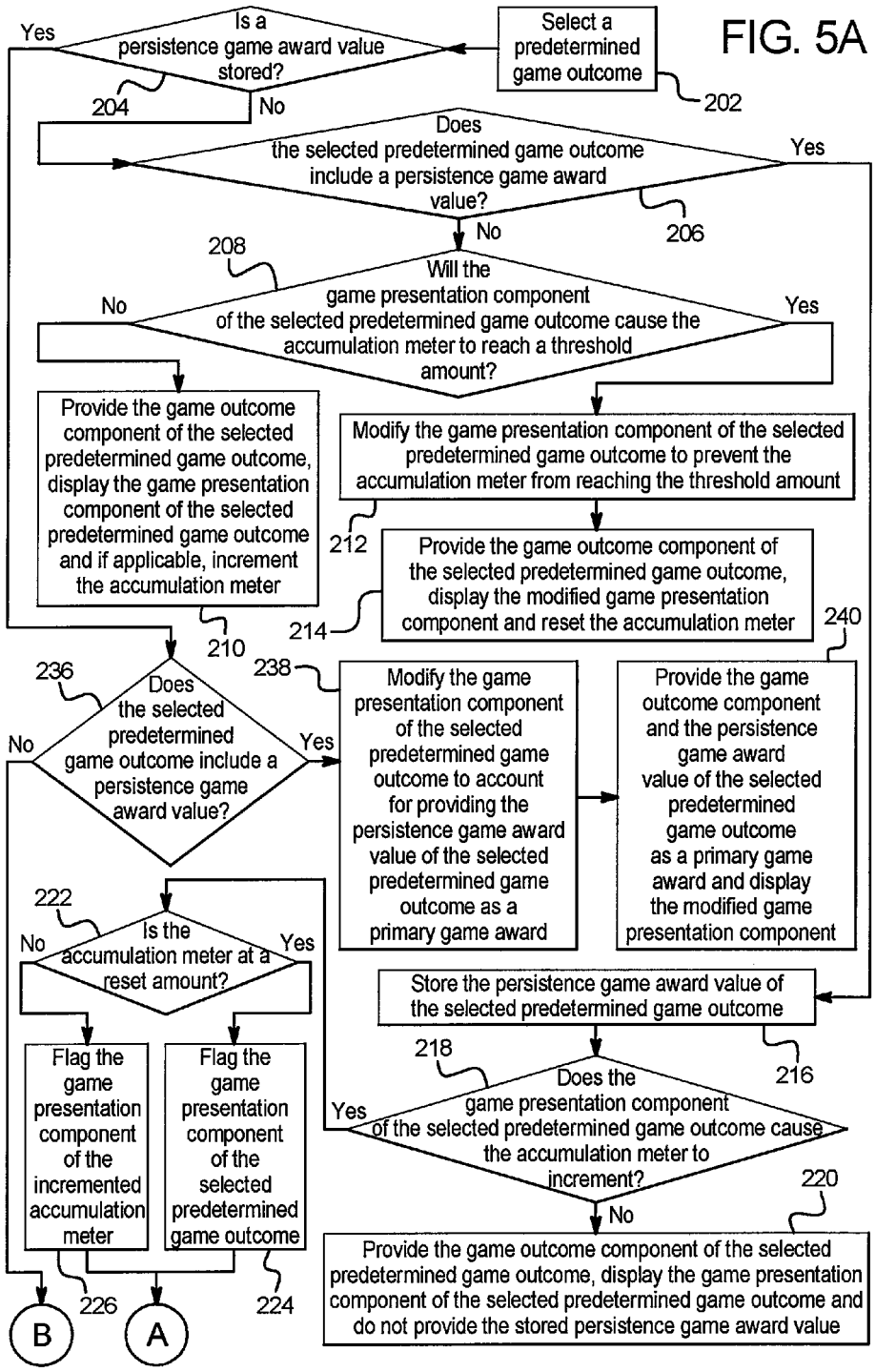
FIG. 5A
Select a predetermined game outcome
202
Is a persistence game award value stored?
204
Yes
No
Does the selected predetermined game outcome include a persistence game award value?
206
Yes
No
Will the game presentation component of the selected predetermined game outcome cause the accumulation meter to reach a threshold amount?
208
No
Yes
Provide the game outcome component of the selected predetermined game outcome, display the game presentation component of the selected predetermined game outcome and if applicable, increment the accumulation meter
210
Modify the game presentation component of the selected predetermined game outcome to prevent the accumulation meter from reaching the threshold amount
212
Provide the game outcome component of the selected predetermined game outcome, display the modified game presentation component and reset the accumulation meter
214
Does the selected predetermined game outcome include a persistence game award value?
236
No
Yes
Modify the game presentation component of the selected predetermined game outcome to account for providing the persistence game award value of the selected predetermined game outcome as a primary game award
238
Provide the game outcome component and the persistence game award value of the selected predetermined game outcome as a primary game award and display the modified game presentation component
240
Is the accumulation meter at a reset amount?
222
No
Yes
Flag the game presentation component of the incremented accumulation meter
Flag the game presentation component of the selected predetermined game outcome
226
224
B
A
Store the persistence game award value of the selected predetermined game outcome
216
Does the game presentation component of the selected predetermined game outcome cause the accumulation meter to increment?
218
Yes
No
Provide the game outcome component of the selected predetermined game outcome, display the game presentation component of the selected predetermined game outcome and do not provide the stored persistence game award value
220

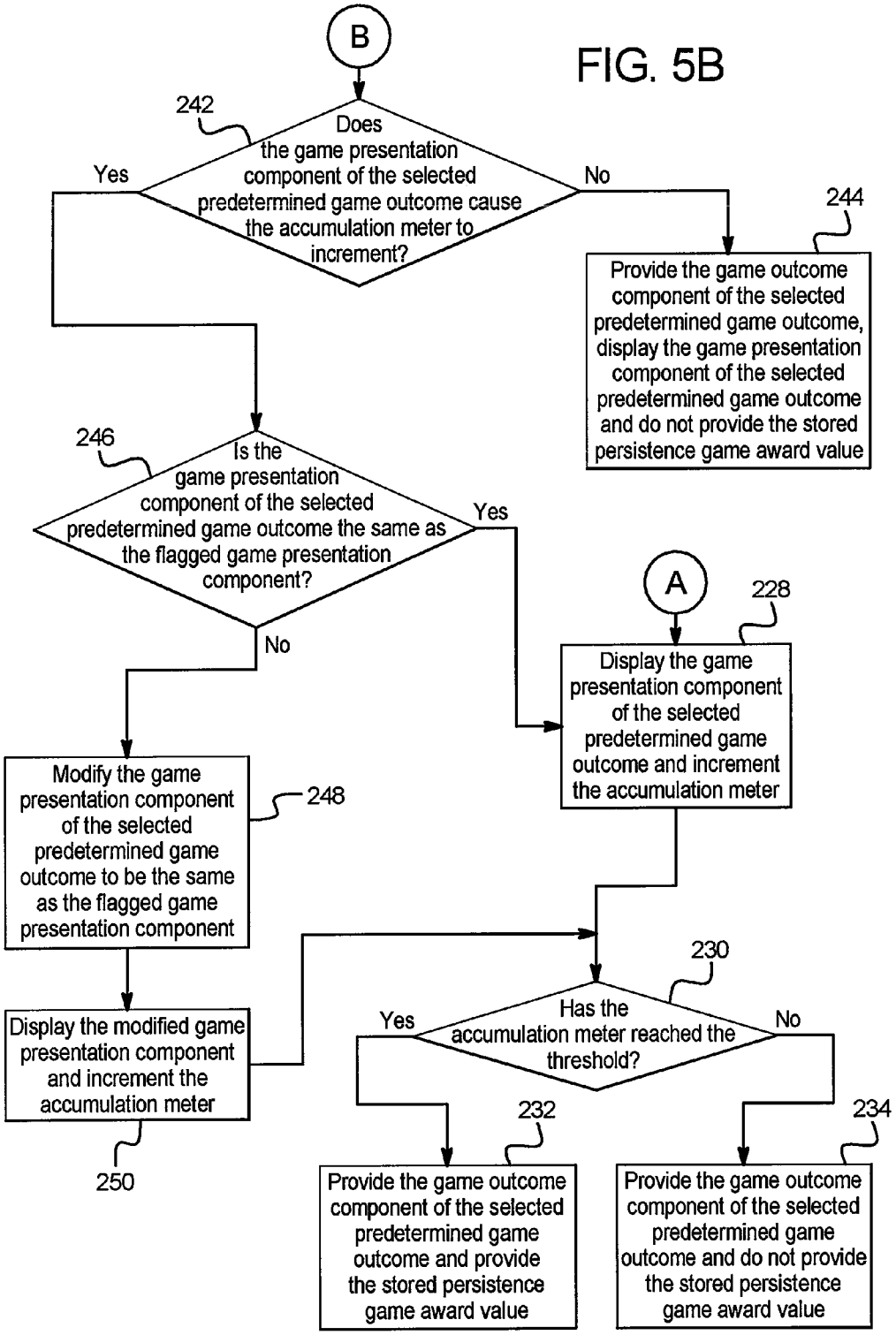
B
FIG. 5B
242
Does the game presentation component of the selected predetermined game outcome cause the accumulation meter to increment?
Yes
No
244
Provide the game outcome component of the selected predetermined game outcome, display the game presentation component of the selected predetermined game outcome and do not provide the stored persistence game award value
246
Is the game presentation component of the selected predetermined game outcome the same as the flagged game presentation component?
Yes
No
A
228
Display the game presentation component of the selected predetermined game outcome and increment the accumulation meter
Modify the game presentation component of the selected predetermined game outcome to be the same as the flagged game presentation component
248
Display the modified game presentation component and increment the accumulation meter
250
230
Has the accumulation meter reached the threshold?
Yes
No
232
Provide the game outcome component of the selected predetermined game outcome and provide the stored persistence game award value
234
Provide the game outcome component of the selected predetermined game outcome and do not provide the stored persistence game award value

CENTRAL DETERMINATION GAMING SYSTEM AND METHOD FOR PROVIDING A PERSISTENCE GAME WITH PREDETERMINED GAME OUTCOMES

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

The majority of the contemporary wagering gaming devices or gaming terminals, such as slot machines, provide games of chance which randomly generate awards and other outcomes. Such Class III gaming terminals typically randomly generate a primary game award for a play of a primary game (e.g., slot machine games, video poker games, video blackjack games, and video Keno games). For such primary games, which primary game award is randomly generated is based on a probability calculation. Such Class III gaming terminals may also randomly generate a secondary game award for a play of any secondary game, wherein which secondary game award is randomly generated is based on a probability calculation. The probabilities of obtaining each of the outcomes, such as the awards in the primary games and the awards in the secondary games and the amount of each of the awards determine the average expected pay out percentage of such Class III gaming terminals. Because the awards or other outcomes of these gaming terminals are randomly determined, there is no certainty that a player will ever obtain any particular award. That is, no matter how many times a player plays a primary game or a secondary game, since these Class III gaming terminal generates outcomes randomly (i.e., based upon a probability calculation), there is no certainty that the gaming terminal will ever provide the player with a certain outcome, such as the highest paying award. On the other hand, due to the random determination, these gaming terminals can provide a certain outcome without limit, such as the highest paying award, numerous times in a small number of plays.

Certain known secondary games of Class III gaming terminals are played over the course of a number of plays of the primary or base game. Such secondary games provide one or more players an award for their persistence in playing the gaming machine for a prolonged number of plays or period of time. In these persistence or persistence-type secondary games, in association with one or more plays of the primary game, a portion of the secondary game is played or at least one secondary game element is provided to the player. After that player (or a different player currently playing at the gaming terminal) has obtained a designated number of secondary game elements (or advanced to the secondary game a designated number of times), these Class III gaming machines provide a secondary game award to the player currently playing the gaming machine. The provided secondary game award is based on the plurality of obtained secondary game elements (or the plurality of plays of the secondary game) which randomly occur based on triggering events associated with the plurality of plays of the primary game. Because the secondary game elements of these gaming terminals are randomly determined, there is no certainty that any player will ever obtain the designated number of secondary game elements to be provided the secondary game award.

One known Class III gaming terminal with a persistence or persistence-type secondary game includes a non-retreating or non-decreasing accumulator or accumulation meter which must be filled to win a secondary game award. The non-retreating accumulator or accumulation meter of this known persistence secondary game will not decrease until the secondary game award is provided. In this persistence secondary game, each time a suitable outcome randomly occurs in association with a play of a primary game, such an accumulation meter increases or is otherwise suitably incremented. After the accumulation meter is full (i.e., the suitable outcome has randomly occurred a designated quantity of times in association with a plurality of plays of a primary game), the gaming terminal provides a secondary game award to the player currently playing at that gaming terminal.

In one version of a persistence secondary game with such an accumulation meter, upon an initiation of a first play of a primary game, the gaming terminal sets the accumulation meter to an initial or reset amount. For each play of the primary game in which the gaming terminal randomly generates a designated outcome, such as a losing game outcome, the gaming terminal increases the accumulation meter. For each play of the primary game in which the gaming terminal randomly generates a non-designated outcome, such as a winning game outcome, the gaming terminal causes the accumulation meter to remain unchanged. In this version, when the accumulation meter increases to a threshold amount (i.e., the gaming terminal has generated a suitable quantity of designated game outcomes), the gaming terminal provides a secondary game award associated with the accumulation meter to the player currently playing at the gaming terminal and resets the accumulation meter. Because the accumulation meter of this persistence secondary game increases based on a suitable outcome randomly occurring in association with a play of a primary game, there is no certainty that the accumulation meter will ever full and the gaming terminal will ever provide a secondary game award to any player.

Another known Class III gaming terminal with a persistence or persistence-type secondary game includes a retreating accumulator or accumulation meter which must be filled to win a secondary game award. The retreating accumulator or accumulation meter of this known persistence secondary game may decrease before the secondary game award is provided. Such an accumulator or accumulation meter increases upon one or more suitable random events occurring in one or more plays of a primary game and decreases if one or more suitable random events do not occur in one or more plays of the primary game. In such secondary games, a previously increased accumulation meter (i.e., a partially-filled accumulation meter) will decrease unless a suitable random event occurs in association with a subsequently played primary game to maintain any previous increase of the accumulation meter. That is, such an accumulator or accumulation meter (i) increases upon one or more suitable first random events occurring in one or more plays of a primary game; (ii) decreases upon one or more suitable second random events occurring in one or more plays of the primary game; and (iii) does not change when no suitable first random events nor suitable second random events occur.

In one version of a known Class III gaming terminal including a persistence secondary game with a retreating accumulator or retreating accumulation meter, upon an initiation of a first play of a primary game, the gaming terminal sets the accumulation meter to an initial or reset amount. If the gaming terminal randomly generates a first type of designated outcome (e.g., a first type of losing game outcome) for the first play of a primary game, the gaming terminal associates the accumulation meter with this type of designated outcome and increases the retreating accumulation meter. In this version, if for a second play of the primary game, the gaming terminal again randomly generates the same type of designated outcome as is currently associated with the accumulation meter (e.g., the first type of losing game outcome is generated again) the gaming terminal increases the retreating accumulation meter. On the other hand, if for the second play of the primary game, the gaming terminal randomly generates a different type of designated outcome than is currently associated with the accumulation meter (e.g., a second, different type of losing game outcome is generated), the gaming terminal resets the retreating accumulation meter, associates the accumulation meter with this, different type of designated outcome and increases the retreating accumulation meter. Moreover, if for the second play of the primary game, the gaming terminal randomly generates a non-designated outcome (e.g., a winning game outcome), the gaming terminal does not increase or decrease the retreating accumulation meter. This process of increasing, decreasing or not modifying (i.e., not increasing or decreasing) the retreating accumulation meter based on the generated primary game outcome continues as described above until the accumulation meter increases to a threshold amount or level.

In one known Class III gaming terminal including a persistence secondary game, when the accumulation meter increases to the threshold amount or level, the gaming terminal provides a secondary game award associated with the accumulation meter to the player currently playing at the gaming terminal and resets the accumulation meter. In another known Class III gaming terminal including a persistence secondary game with a plurality of different threshold amounts or levels, when the accumulation meter increases to the threshold amount or level, the gaming terminal enables the player currently playing at the gaming terminal to either accept the secondary game award associated with the current threshold level of the accumulation meter or reject this secondary game award and attempt to increment the accumulation meter as described above to another, higher threshold level. Because the accumulation meter of this persistence secondary game increases based on a random event occurring and further decreases based on a random event not occurring, there is no certainty that the accumulation meter will ever full and the gaming terminal will ever provide a secondary game award to any player.

The above-described uncertainties are faced by both players and casinos (or other gaming establishments). For example, certain casinos prefer that a relatively high number of players hit low awards while a relatively low number of players hit high awards. When players hit high awards periodically, certain casinos can attract more players, because of the positive publicity these large wins generate. By using desired payback percentages or probabilities, the casinos can also expect to make a certain level of profit. The random determinations can, however, unexpectedly cause casinos to suffer a loss or, on the other hand, to reap great profit in the short run and lose business in the long run due to a reputation for only paying out low awards. In other words, a given casino can expect to earn a certain profit percentage in the long term for a given casino game. However, over a designated period of time, a given casino can also suffer a financial loss on a given game. That is, a game with more-frequent high-value awards above a certain high-value threshold is mathematically more likely to generate a loss for the casino over the designated period of time relative to a similar game (with an equal long-term payback percentage) that has less-frequent high-value awards above the high-value threshold (and a greater likelihood of providing lower-value awards at or below the high-value threshold). Accordingly, a typical casino offering Class III games must balance its interest in reducing its financial risk with the interests of certain players that prefer games with more-frequent high-value awards above a certain high-value threshold.

Regulatory bodies in certain jurisdictions do not permit the use of probability-based gaming terminals in-part for certain of these reasons. These regulatory bodies instead permit the use of Class II wagering gaming terminals which are provided in two major forms: (1) a bingo-based Class II systems and (2) a central pull-tab systems. Typical bingo-based Class II systems provide awards based on the automatic play of a multi-player bingo game, wherein the bingo-game outcomes are displayed in a bingo-game form (and/or a slot game form, a video poker game form or any suitable form). Typical central pull-tab systems provide a set or pool of certain or definite awards. Certain pull-tab outcome pools, often referred to as paper pull-tabs, provide game outcomes via a physical collection of paper-tickets. Certain pull-tab outcome pools, often referred to as electronic pull-tabs, provide game outcomes via a collection of data in an electronic or electromechanical data storage mechanism. Generally, in pull tab based systems, a certain number of wins are guaranteed and the overall amount paid back to players is guaranteed. That is, the actual payback percentage is static and not an average expected amount.

In certain jurisdictions, to comply with the above-mentioned regulatory rules that do not permit the use of probability-based gaming terminals, centralized electronic pull-tab systems, also known as central determination gaming systems (including a plurality of individual gaming terminals in communication with a central processor or controller) have been implemented wherein the central system maintains one or more predetermined pools or sets of predetermined game outcomes. Each predetermined game outcome in each set or pool includes a game outcome component (i.e., a win, a loss, a secondary game trigger or other suitable outcome) with an associated value or payout amount, if any, and a game presentation component (i.e., how the game outcome is displayed or presented to the player). In these systems, when a player makes a wager on one of the Class II gaming terminals, the central system independently selects a predetermined game outcome from a set or pool of predetermined game outcomes and flags or marks the selected game outcome as used. Once a game outcome is flagged as used, it is prevented from further selection from the set or pool and cannot be selected by the central controller upon another wager. The selected predetermined game outcome is communicated to the individual gaming terminal. The individual gaming terminal displays or presents the game presentation component and provides the player the game outcome component with the associated value, if any, for the selected game outcome. This type of Class II central determination gaming system provides players with all of the available predetermined game outcomes over the course of the play cycle and guarantees the actual wining outcomes and losing outcomes in the pool or set.

In addition to central determination gaming systems which provided predetermined game outcomes, other known Class II gaming terminals are configured to provide a player a predetermined game outcome. In these gaming terminals, rather than receiving a predetermined game outcome from a central controller, the gaming terminal stores a plurality of predetermined game outcomes in a memory device. Upon a player initiating a game at the gaming terminal, the predetermined game outcome which will ultimately be provided to the player is selected and flagged or marked as used. The gaming terminal then proceeds with one or more game sequences and upon the conclusion of the game sequences, the selected predetermined game outcome is provided to the player. In another version of a Class II gaming terminal, a predetermined game outcome is determined based on the results of a bingo or keno game. In this version, a plurality of individual gaming terminal each utilizes one or more bingo or keno games to determine the predetermined game outcome which will be provided to the player for any game played at that gaming terminal.

As the predetermined game outcome in a central determination gaming system is selected by the central controller for each game played and as the game outcome in a persistence secondary game is determined over a plurality of plays of the secondary game, no known central determination gaming system provides a predetermined game outcome as a result of a persistence secondary game. That is, an inconsistency occurs between providing a separate predetermined game outcome for each game played (i.e., a central determination gaming system) and providing one outcome for a plurality of games played (i.e., a persistence secondary game). Moreover, an inconsistency occurs between Class III gaming terminals with a persistence secondary game that is uncertain to ever provide a secondary game award to a player and Class II gaming terminals with predetermined outcomes that are guaranteed to be provided to a player. Accordingly, a need exists to provide a persistence secondary game that is operational in a central determination gaming system.

SUMMARY

In various embodiments, the Class II central determination gaming system and method disclosed herein provides a persistence secondary game which utilizes predetermined game outcomes. In one embodiment, one or more predetermined game outcomes include a persistence game award value. In one such embodiment, if a predetermined game outcome including such a persistence game award value is selected to be provided to the player in association with a first play of a primary game, the gaming system determines whether to provide this persistence game award value to a player in association with the first play of a primary game or to store this persistence game award value to be subsequently provided to a player in association with a subsequent play of a primary game. In this embodiment, the determination of whether to provide or store the persistence game award value is based on the then current progress of the persistence game (i.e., the current state of a non-retreating accumulation meter). In another such embodiment, if a predetermined game outcome including such a persistence game award value is selected in association with a first play of a primary game, the gaming system additionally determines whether to modify or alter how zero, one or more selected predetermined game outcomes are displayed and/or whether to modify the award provided to the player for one or more plays of a primary game. In this embodiment, the determination of whether to modify how zero, one or more selected predetermined game outcomes are displayed and/or whether to modify the award provided to the player for one or more plays of the primary game is based on the current progress of the persistence game (i.e., the current state of a retreating accumulation meter). Such modifications ensure that the gaming system causes the accumulation meter to reach a threshold level and the gaming system provides the persistence game award value to a player after one or more subsequent plays of the primary game. That is, to provide that a predetermined persistence game award value is provided to a player upon the completion of one or more subsequent plays of the primary game, the central determination gaming system disclosed herein controls or alters one or more aspects of such subsequently played primary games. Accordingly, these embodiments provide a persistence secondary game in a central determination gaming system.

In one embodiment, upon the initiation of a first play of a primary game, a predetermined game outcome is selected. The predetermined game outcome includes a game outcome component (i.e., a win, or a loss) with an associated primary game outcome value or payout amount, if any, and a game presentation component (i.e., how the game outcome is displayed or presented to the player). In one embodiment, the predetermined game outcomes may also include a persistence game award value. Such a persistence game award value is an award amount that is ultimately provided to a player as a result of a persistence game. As described below, although a predetermined game outcome selected in association with a first play of a primary game includes a persistence game award value, that persistence game award value may not be provided to the player in association with the first play of the primary game (i.e., simultaneously with the game outcome value of the predetermined game outcome that is selected in association with the first play of the primary game), but rather may be provided to that player (or another player) in association with a second, subsequent play of a primary game. That is, a persistence game award value may be selected to be provided to a player in association with a current play of a game, but the gaming system prevents this selected persistence game award value from being displayed, indicated or provided to that player in association with the current play of the game. As described below, such control over the timing of when to provide a persistence game award value enables the Class II gaming system disclosed herein to provide such game award values via a persistence secondary game with a retreating accumulation meter.

In one embodiment, a set or pool of predetermined game outcomes is stored in a central controller. In this embodiment, upon a player initiating game play at the gaming device, the initiated gaming device communicates a game outcome request to the central controller. Upon receiving the game outcome request, the central controller independently selects a predetermined game outcome from the set or pool of predetermined game outcomes and flags or marks the selected predetermined game outcome as used. Once a predetermined game outcome is flagged as used, it is prevented from further selection from the set or pool and cannot be selected by the central controller upon another wager. The selected predetermined game outcome is communicated to the individual gaming device to be utilized in the initiated primary game. In another embodiment, the set or pool of predetermined game outcomes is stored in a memory device of the gaming device. In this embodiment, the gaming device selects a predetermined game outcome from the set or pool of stored predetermined game outcomes and flags the selected predetermined game outcome as used. In another embodiment, upon a player initiating game play at the gaming device, the gaming device enrolls in a bingo game. In this embodiment, a bingo server calls the bingo balls that result in a specific game outcome. The resultant game outcome is communicated to the individual gaming device to be utilized in the initiated primary game.

In one embodiment of a Class II gaming system that includes a persistence secondary game with a non-retreating accumulator or accumulation meter, if the selected predetermined game outcome does not include a persistence game award value, the selected predetermined game outcome is provided to the player for the play of the primary game and the non-retreating accumulation meter of the persistence game is left unchanged. On the other hand, if the selected predetermined game outcome includes a persistence game award value, the predetermined game outcome is provided to the player for the play of the primary game and the non-retreating accumulation meter of the persistence game is increased or incremented. In this embodiment, the amount the non-retreating accumulation meter is increased is based, at least in part, on the persistence game award value of the selected predetermined game outcome. For example, if a predetermined game outcome including a win $5 game outcome component and a persistence game award value of $2 is selected, the gaming device provides the player the $5 winning game outcome for the play of the primary game and increases the accumulation meter of the persistence game to account for the persistence game award value of $2.

After increasing the non-retreating accumulation meter, the gaming system determines if the non-retreating accumulation meter has reached a designated threshold count, a designated threshold amount or a designated threshold level (i.e., the gaming system determines the current progress or status of the persistence game). If the non-retreating accumulation meter has not reached the designated threshold count, the gaming system awaits for another event which increase the accumulation meter, such as the selection of another predetermined game outcome including a persistence game award value as described above. In this embodiment, the gaming system stores, caches or banks the persistence game award value of the currently selected predetermined game outcome to be provided in association with a subsequent play of the primary game. For example, if a first persistence game award value of $2 does not cause the non-retreating accumulation meter to reach the designated threshold count, at that point in time, the gaming device does not provide this first persistence game award value of $2 to a player, but rather stores this first persistence game award value to be provided in association with a subsequent play of a primary game.

On the other hand, if the non-retreating accumulation meter has reached the designated threshold count, the gaming system not only provides the persistence game award value of the then currently selected predetermined game outcome, but the gaming system also provides any stored, previously unprovided persistence game award values of any previously selected game outcomes. For example, if a second persistence game award value of $3 causes the non-retreating accumulation meter to reach the designated threshold count, the gaming device currently provides this second persistence game award value of $3 to the player and further provides any stored persistence game award values associated with the non-retreating accumulation meter to the player, such as the first persistence game award value of $2 from the previous example. Accordingly, by storing one or more persistence game award values in association with the ongoing play of the persistence game, the Class II gaming system disclosed herein provides a persistence game which provides predetermined game outcomes.

It should be appreciated that in this embodiment, regardless of whether a persistence game award value is provided to a player in association with a current play of a primary game or banked to be provided to that player (or another player) in association with a subsequent play of a primary game, the gaming system disclosed herein accounts for this persistence game award value as provided to one of the players of one of the gaming devices in the gaming system. For example, regardless of if a persistence game award value of $2 is provided to a first player for a first game played at the first point in time (i.e., the persistence game award value of $2 caused the non-retreating accumulation meter to reach the designated threshold count) or provided to a second, different player for a second game played at a second, subsequent point in time (i.e., the persistence game award value of $2 increased the non-retreating accumulation meter toward but not to the designated threshold count), the gaming system considers the persistence game award value of $2 as provided (even if which player that the persistence game award value of $2 is provided to is undetermined). Such a configuration provides a persistence secondary game which utilizes a non-retreating accumulation meter to provide a predetermined game outcome to a player.

In another embodiment of a Class II gaming system that includes a persistence secondary game with a retreating accumulator or accumulation meter, the gaming system factors in at least the current status of the accumulation meter, the game presentation component of the selected predetermined game outcome and/or the previous storage of any persistence game award values in determining how to proceed. In this embodiment, upon the selection of a predetermined game outcome, the gaming system determines if the selected predetermined game outcome includes a persistence game award value and also determines if a persistence game award value is previously stored or cached. If the selected predetermined game outcome includes a persistence game award value, then based on if a persistence game award value is previously stored or cached, the gaming device either provides the selected predetermined game outcome and the persistence game award value to the player or provides the selected predetermined game outcome to the player and stores (i.e., does not provide) the persistence game award value of the selected predetermined game outcome. Additionally, in this embodiment, if the selected predetermined game outcome is not associated with a persistence game award value, then based on if a persistence game award value is previously stored and based on the current status of the accumulation meter of the persistence game, the gaming device either provides the selected predetermined game outcome or provides the selected predetermined game outcome to the player and also provides the stored persistence game award value associated with a previously selected predetermined game outcome.

In one such embodiment employing a retreating accumulation meter, since the retreating accumulation meter may decrease or reset unless a designated game outcome is displayed in association with a play of the primary game and the game presentation component of a selected predetermined game outcome may not be the designated game outcome, the gaming system is configured to modify the game presentation component of one or more selected predetermined game outcomes to ensure that the retreating accumulation meter does not reset. Such a modification provides that a persistence game award value will be provided to a player within a minimum amount of plays of the primary game. Specifically, if a persistence game award value is previously stored and the game presentation component of the selected predetermined game outcome would otherwise cause the accumulation meter to decrease or reset, the gaming device modifies the game presentation component of the selected predetermined game outcome to prevent the accumulation meter from decreasing or resetting. For example, if the selected predetermined game outcome for a first play of a primary game is associated with a persistence game award value, the gaming device will flag the game presentation component of the selected predetermined game outcome. In this example embodiment, until the accumulation meter increases to the threshold count, for each subsequently selected predetermined game outcome that would cause the accumulation meter to decrease or reset, the gaming device changes or otherwise modifies the game presentation component of such subsequently selected predetermined game outcomes to cause the accumulation meter to increment or increase. Accordingly, to prevent the accumulation meter from decreasing (and thus to prevent any delay in providing the stored persistence game award value to a player), if the game presentation component of zero, one or more subsequently selected predetermined game outcomes is different from the flagged game presentation component, the gaming system disclosed herein modifies such game presentation components to the flagged game presentation components.

In another such embodiment employing a retreating accumulation meter, the gaming system stores a single persistence game award value in association with the accumulation meter (and does not store a plurality of persistence game award values in association with the accumulation meter). In this embodiment, since a single persistence game award value may be stored at once, if a first persistence game award value is previously stored and a selected predetermined game outcome includes a second persistence game award value, the gaming system is configured to combine this second persistence game award value with any primary game award value of the selected predetermined game outcome and provide this modified value to a player as a primary game award. Such a modification ensures that each persistence game award value is provided to a player in a timely fashion.

Additional features and advantages are described in, and will be apparent from, the following Detailed Description and the figures.

BRIEF DESCRIPTION OF THE FIGURES

FIGS. 5A and 5B are a flowchart of one embodiment of the gaming system disclosed herein illustrating a predetermined persistence game award value provided to a player via a persistence secondary game with a retreating accumulation meter.

DETAILED DESCRIPTION

The present disclosure may be implemented in various configurations for gaming machines, gaming devices or gaming systems, including but not limited to: (1) a dedicated gaming machine, gaming device or gaming system wherein the computerized instructions for controlling any games (which are provided by the gaming machine or gaming device) are provided with the gaming machine or gaming device prior to delivery to a gaming establishment; and (2) a changeable gaming machine, gaming device or gaming system where the computerized instructions for controlling any games (which are provided by the gaming machine or gaming device) are downloadable to the gaming machine or gaming device through a data network when the gaming machine or gaming device is in a gaming establishment. In one embodiment, the computerized instructions for controlling any games are executed by at least one central server, central controller or remote host. In such a "thin client" embodiment, the central server remotely controls any games (or other suitable interfaces) and the gaming device is utilized to display such games (or suitable interfaces) and receive one or more inputs or commands from a player. In another embodiment, the computerized instructions for controlling any games are communicated from the central server, central controller or remote host to a gaming device local processor and memory devices. In such a "thick client" embodiment, the gaming device local processor executes the communicated computerized instructions to control any games (or other suitable interfaces) provided to a player.

In one embodiment, one or more gaming devices in a gaming system may be thin client gaming devices and one or more gaming devices in the gaming system may be thick client gaming devices. In another embodiment, certain functions of the gaming device are implemented in a thin client environment and certain other functions of the gaming device are implemented in a thick client environment. In one such embodiment, computerized instructions for controlling any primary games are communicated from the central server to the gaming device in a thick client configuration and computerized instructions for controlling any secondary games or bonus functions are executed by a central server in a thin client configuration.

Figure 1A:
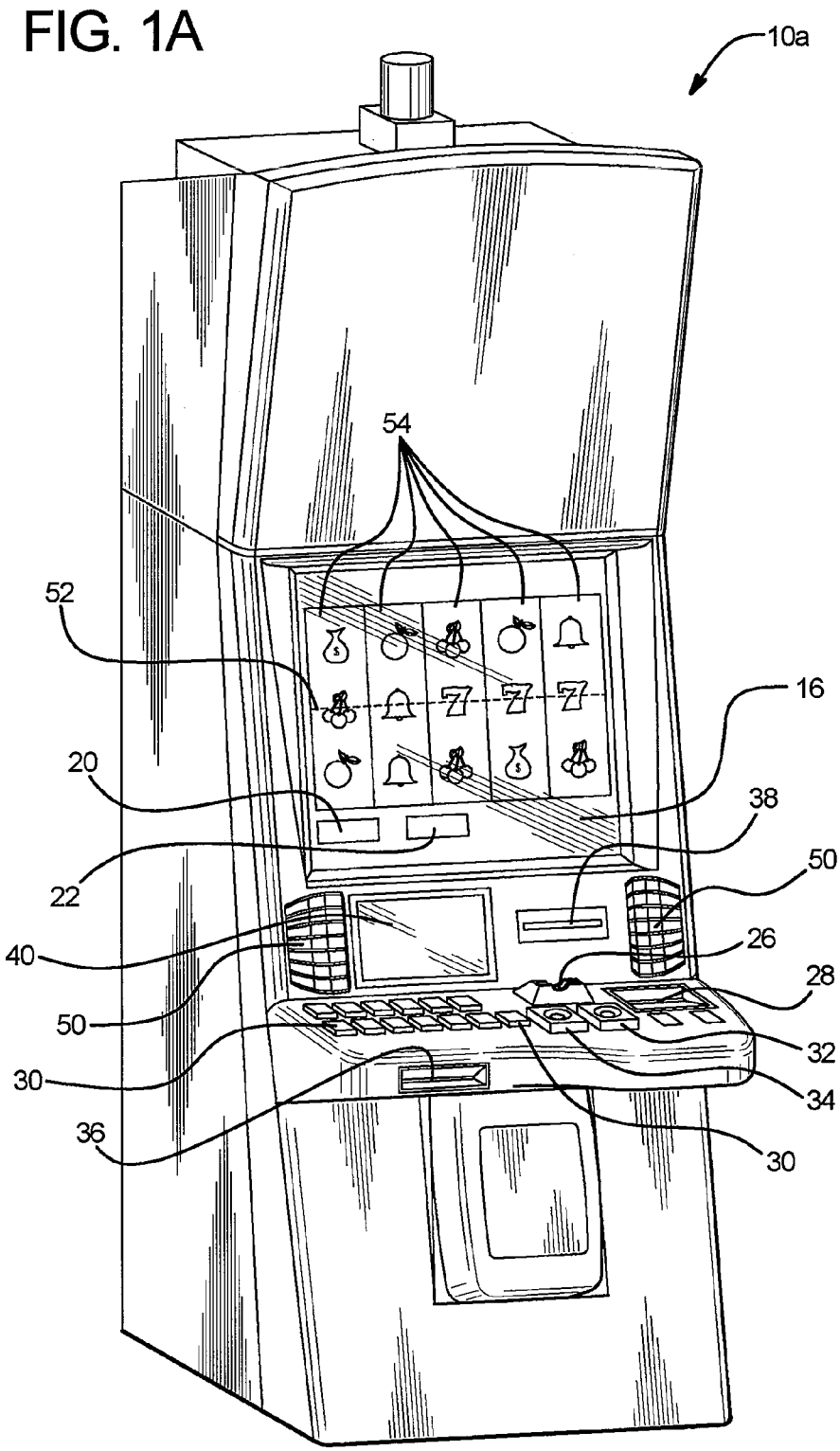
FIGS. 1A and 1B are front perspective views of alternative embodiments of gaming devices disclosed herein.
Figure 1B:
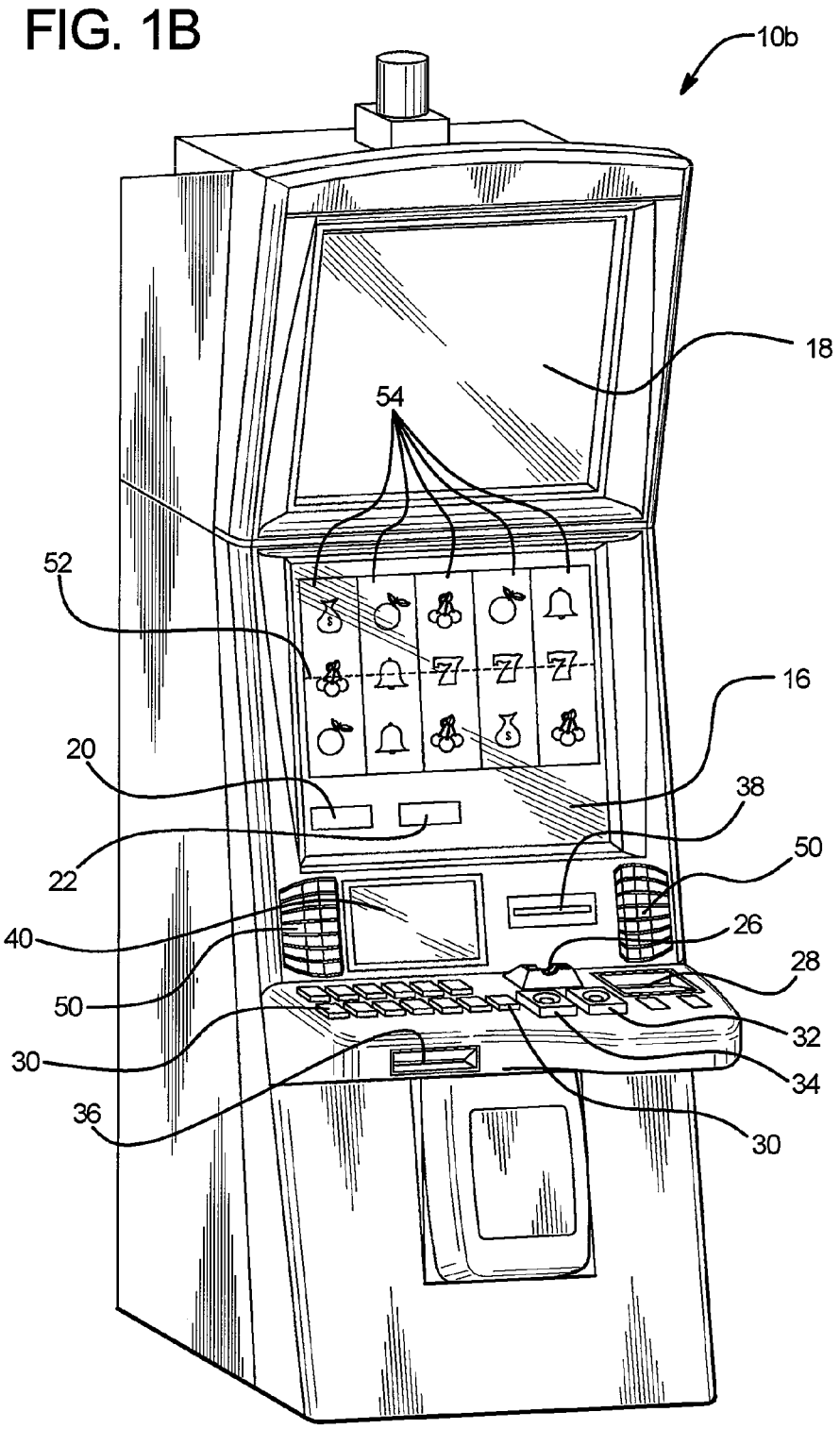

Referring now to the drawings, two example alternative embodiments of the gaming device disclosed herein are illustrated in FIGS. 1A and 1B as gaming device 10*a* and gaming device 10*b*, respectively. Gaming device 10*a* and/or gaming device 10*b* are generally referred to herein as gaming device 10.

In the embodiments illustrated in FIGS. 1A and 1B, gaming device 10 has a support structure, housing or cabinet which provides support for a plurality of displays, inputs, controls and other features of a conventional gaming machine. It is configured so that a player can operate it while standing or sitting. The gaming device may be positioned on a base or stand or can be configured as a pub-style table-top game (not shown) which a player can operate preferably while sitting. As illustrated by the different configurations shown in FIGS. 1A and 1B, the gaming device may have varying cabinet and display configurations.

Figure 2A:
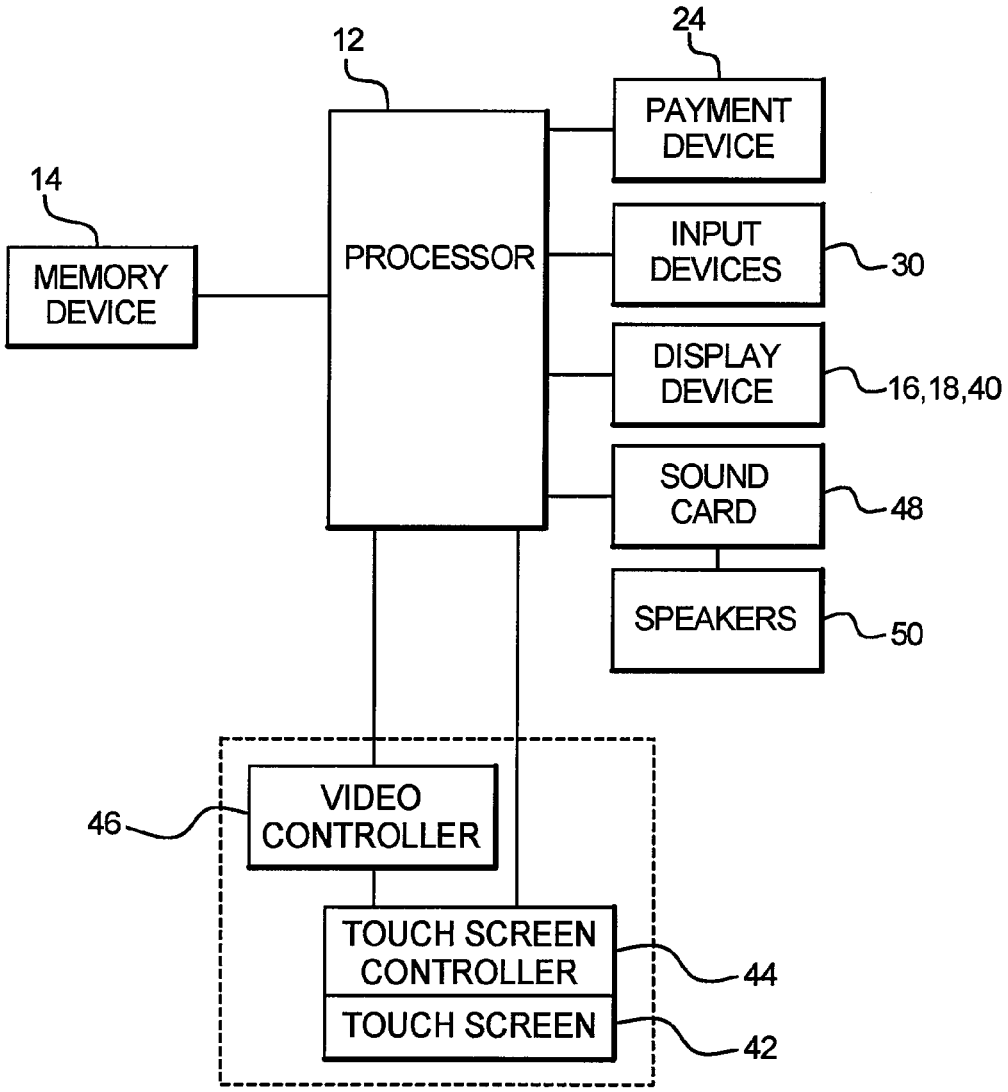
FIG. 2A is a schematic block diagram of the electronic configuration of one embodiment of a gaming device disclosed herein.

In one embodiment, as illustrated in FIG. 2A, the gaming device preferably includes at least one processor 12, such as a microprocessor, a microcontroller-based platform, a suitable integrated circuit or one or more application-specific integrated circuits (ASIC's). The processor is in communication with or operable to access or to exchange signals with at least one data storage or memory device 14. In one embodiment, the processor and the memory device reside within the cabinet of the gaming device. The memory device stores program code and instructions, executable by the processor, to control the gaming device. The memory device also stores other data such as image data, event data, player input data, random or pseudo-random number generators, pay-table data or information and applicable game rules that relate to the play of the gaming device. In one embodiment, the memory device includes random access memory (RAM), which can include non-volatile RAM (NVRAM), magnetic RAM (MRAM), ferroelectric RAM (FeRAM) and other forms as commonly understood in the gaming industry. In one embodiment, the memory device includes read only memory (ROM). In one embodiment, the memory device includes flash memory and/or EEPROM (electrically erasable programmable read only memory). Any other suitable magnetic, optical and/or semiconductor memory may operate in conjunction with the gaming device disclosed herein.

In one embodiment, part or all of the program code and/or operating data described above can be stored in a detachable or removable memory device, including, but not limited to, a suitable cartridge, disk, CD ROM, DVD or USB memory device. In other embodiments, part or all of the program code and/or operating data described above can be downloaded to the memory device through a suitable network.

In one embodiment, an operator or a player can use such a removable memory device in a desktop computer, a laptop personal computer, a personal digital assistant (PDA), portable computing device, or other computerized platform to implement the present disclosure. In one embodiment, the gaming device or gaming machine disclosed herein is operable over a wireless network, such as part of a wireless gaming system. In this embodiment, the gaming machine may be a hand held device, a mobile device or any other suitable wireless device that enables a player to play any suitable game at a variety of different locations. It should be appreciated that a gaming device or gaming machine as disclosed herein may be a device that has obtained approval from a regulatory gaming commission or a device that has not obtained approval from a regulatory gaming commission. It should be appreciated that the processor and memory device may be collectively referred to herein as a "computer" or "controller."

In one embodiment, as discussed in more detail below, the gaming device employs a predetermined or finite set or pool of awards or other game outcomes. In this embodiment, as each award or other game outcome is provided to the player, the gaming device flags or removes the provided award or other game outcome from the predetermined set or pool. Once flagged or removed from the set or pool, the specific provided award or other game outcome from that specific pool cannot be provided to the player again. This type of gaming device provides players with all of the available awards or other game outcomes over the course of the play cycle and guarantees the amount of actual wins and losses.

In another embodiment, as discussed below, upon a player initiating game play at the gaming device, the gaming device enrolls in a bingo game. In this embodiment, a bingo server calls the bingo balls that result in a specific bingo game outcome. The resultant game outcome is communicated to the individual gaming device to be provided to a player. In one embodiment, this bingo outcome is displayed to the player as a bingo game and/or in any form in accordance with the present disclosure.

In one embodiment, as illustrated in FIG. 2A, the gaming device includes one or more display devices controlled by the processor. The display devices are preferably connected to or mounted to the cabinet of the gaming device. The embodiment shown in FIG. 1A includes a central display device 16 which displays a primary game. This display device may also display any suitable secondary game associated with the primary game as well as information relating to the primary or secondary game. The alternative embodiment shown in FIG. 1B includes a central display device 16 and an upper display device 18. The upper display device may display the primary game, any suitable secondary game associated or not associated with the primary game and/or information relating to the primary or secondary game. These display devices may also serve as digital glass operable to advertise games or other aspects of the gaming establishment. As seen in FIGS. 1A and 1B, in one embodiment, the gaming device includes a credit display 20 which displays a player's current number of credits, cash, account balance or the equivalent. In one embodiment, the gaming device includes a bet display 22 which displays a player's amount wagered. In one embodiment, as described in more detail below, the gaming device includes a player tracking display 40 which displays information regarding a player's playing tracking status.

In another embodiment, at least one display device may be a mobile display device, such as a PDA or tablet PC, that enables play of at least a portion of the primary or secondary game at a location remote from the gaming device.

The display devices may include, without limitation, a monitor, a television display, a plasma display, a liquid crystal display (LCD) a display based on light emitting diodes (LED), a display based on a plurality of organic light-emitting diodes (OLEDs), a display based on polymer light-emitting diodes (PLEDs), a display based on a plurality of surface-conduction electron-emitters (SEDs), a display including a projected and/or reflected image or any other suitable electronic device or display mechanism. In one embodiment, as described in more detail below, the display device includes a touch-screen with an associated touch-screen controller. The display devices may be of any suitable size and configuration, such as a square, a rectangle or an elongated rectangle.

The display devices of the gaming device are configured to display at least one and preferably a plurality of game or other suitable images, symbols and indicia such as any visual representation or exhibition of the movement of objects such as mechanical, virtual or video reels and wheels, dynamic lighting, video images, images of people, characters, places, things and faces of cards, and the like.

In one alternative embodiment, the symbols, images and indicia displayed on or of the display device may be in mechanical form. That is, the display device may include any electromechanical device, such as one or more mechanical objects, such as one or more rotatable wheels, reels or dice, configured to display at least one or a plurality of game or other suitable images, symbols or indicia.

As illustrated in FIG. 2A, in one embodiment, the gaming device includes at least one payment device 24 in communication with the processor. As seen in FIGS. 1A and 1B, a payment device such as a payment acceptor includes a note, ticket or bill acceptor 28 wherein the player inserts paper money, a ticket or voucher and a coin slot 26 where the player inserts money, coins, or tokens. In other embodiments, payment devices such as readers or validators for credit cards, debit cards or credit slips may accept payment. In one embodiment, a player may insert an identification card into a card reader of the gaming device. In one embodiment, the identification card is a smart card having a programmed microchip or a magnetic strip coded with a player's identification, credit totals (or related data) and other relevant information. In another embodiment, a player may carry a portable device, such as a cell phone, a radio frequency identification tag or any other suitable wireless device, which communicates a player's identification, credit totals (or related data) and other relevant information to the gaming device. In one embodiment, money may be transferred to a gaming device through electronic funds transfer. When a player funds the gaming device, the processor determines the amount of funds entered and displays the corresponding amount on the credit or other suitable display as described above.

As seen in FIGS. 1A, 1B and 2A, in one embodiment the gaming device includes at least one and preferably a plurality of input devices 30 in communication with the processor. The input devices can include any suitable device which enables the player to produce an input signal which is received by the processor. In one embodiment, after appropriate funding of the gaming device, the input device is a game activation device, such as a play button 32 or a pull arm (not shown) which is used by the player to start any primary game or sequence of events in the gaming device. The play button can be any suitable play activator such as a bet one button, a max bet button or a repeat the bet button. In one embodiment, upon appropriate funding, the gaming device begins the game play automatically. In another embodiment, upon the player engaging one of the play buttons, the gaming device automatically activates game play.

In one embodiment, one input device is a bet one button. The player places a bet by pushing the bet one button. The player can increase the bet by one credit each time the player pushes the bet one button. When the player pushes the bet one button, the number of credits shown in the credit display preferably decreases by one, and the number of credits shown in the bet display preferably increases by one. In another embodiment, one input device is a bet max button (not shown) which enables the player to bet the maximum wager permitted for a game of the gaming device.

In one embodiment, one input device is a cash out button 34. The player may push the cash out button and cash out to receive a cash payment or other suitable form of payment corresponding to the number of remaining credits. In one embodiment, when the player cashes out, a payment device, such as a ticket, payment or note generator 36 prints or otherwise generates a ticket or credit slip to provide to the player. The player receives the ticket or credit slip and may redeem the value associated with the ticket or credit slip via a cashier (or other suitable redemption system). In another embodiment, when the player cashes out, the player receives the coins or tokens in a coin payout tray. It should be appreciated that any suitable payout mechanisms, such as funding to the player's electronically recordable identification card may be implemented in accordance with the gaming device disclosed herein.

In one embodiment, as mentioned above and seen in FIG. 2A, one input device is a touch-screen 42 coupled with a touch-screen controller 44, or some other touch-sensitive display overlay to allow for player interaction with the images on the display. The touch-screen and the touch-screen controller are connected to a video controller 46. A player can make decisions and input signals into the gaming device by touching the touch-screen at the appropriate places. One such input device is a conventional touch-screen button panel.

The gaming device may further include a plurality of communication ports for enabling communication of the processor with external peripherals, such as external video sources, expansion buses, game or other displays, an SCSI port or a key pad.

In one embodiment, as seen in FIG. 2A, the gaming device includes a sound generating device controlled by one or more sounds cards 48 which function in conjunction with the processor. In one embodiment, the sound generating device includes at least one and preferably a plurality of speakers 50 or other sound generating hardware and/or software for generating sounds, such as playing music for the primary and/or secondary game or for other modes of the gaming device, such as an attract mode. In one embodiment, the gaming device provides dynamic sounds coupled with attractive multimedia images displayed on one or more of the display devices to provide an audio-visual representation or to otherwise display full-motion video with sound to attract players to the gaming device. During idle periods, the gaming device may display a sequence of audio and/or visual attraction messages to attract potential players to the gaming device. The videos may also be customized for or to provide any appropriate information.

In one embodiment, the gaming machine may include a sensor, such as a camera in communication with the processor (and possibly controlled by the processor) that is selectively positioned to acquire an image of a player actively using the gaming device and/or the surrounding area of the gaming device. In one embodiment, the camera may be configured to selectively acquire still or moving (e.g., video) images and may be configured to acquire the images in either an analog, digital or other suitable format. The display devices may be configured to display the image acquired by the camera as well as display the visible manifestation of the game in split screen or picture-in-picture fashion. For example, the camera may acquire an image of the player and the processor may incorporate that image into the primary and/or secondary game as a game image, symbol or indicia.

Gaming device 10 can incorporate any suitable wagering primary or base game. The gaming machine or device may include some or all of the features of conventional gaming machines or devices. The primary or base game may comprise any suitable reel-type game, card game, cascading or falling symbol game, number game or other game of chance susceptible to representation in an electronic or electromechanical form. That is, different primary wagering games, such as video poker games, video blackjack games, video keno, video bingo or any other suitable primary or base game may be implemented.

In one embodiment, as illustrated in FIGS. 1A and 1B, a base or primary game may be a slot game with one or more paylines 52. The paylines may be horizontal, vertical, circular, diagonal, angled or any combination thereof. In this embodiment, the gaming device includes at least one and preferably a plurality of reels 54, such as three to five reels 54, in either electromechanical form with mechanical rotating reels or video form with simulated reels and movement thereof. In one embodiment, an electromechanical slot machine includes a plurality of adjacent, rotatable reels which may be combined and operably coupled with an electronic display of any suitable type. In another embodiment, if the reels 54 are in video form, one or more of the display devices, as described above, display the plurality of simulated video reels 54. Each reel 54 displays a plurality of indicia or symbols, such as bells, hearts, fruits, numbers, letters, bars or other images which preferably correspond to a theme associated with the gaming device. In another embodiment, one or more of the reels are independent reels or unisymbol reels. In this embodiment, each independent or unisymbol reel generates and displays one symbol to the player. In one embodiment, the gaming device awards prizes after the reels of the primary game stop spinning if specified types and/or configurations of indicia or symbols occur on an active payline or otherwise occur in a winning pattern, occur on the requisite number of adjacent reels and/or occur in a scatter pay arrangement.

In an alternative embodiment, rather than determining any outcome to provide to the player by analyzing the symbols generated on any wagered upon paylines as described above, the gaming device determines any outcome to provide to the player based on the number of associated symbols which are generated in active symbol positions on the requisite number of adjacent reels (i.e., not on paylines passing through any displayed winning symbol combinations). In this embodiment, if a winning symbol combination is generated on the reels, the gaming device provides the player one award for that occurrence of the generated winning symbol combination. For example, if one winning symbol combination is generated on the reels, the gaming device will provide a single award to the player for that winning symbol combination (i.e., not based on the number of paylines that would have passed through that winning symbol combination). It should be appreciated that because a gaming device with wagering on ways to win provides the player one award for a single occurrence of a winning symbol combination and a gaming device with paylines may provide the player more than one award for the same occurrence of a single winning symbol combination (i.e., if a plurality of paylines each pass through the same winning symbol combination), it is possible to provide a player at a ways to win gaming device with more ways to win for an equivalent bet or wager on a traditional slot gaming device with paylines.

In one embodiment, the total number of ways to win is determined by multiplying the number of symbols generated in active symbol positions on a first reel by the number of symbols generated in active symbol positions on a second reel by the number of symbols generated in active symbol positions on a third reel and so on for each reel of the gaming device with at least one symbol generated in an active symbol position. For example, a three reel gaming device with three symbols generated in active symbol positions on each reel includes 27 ways to win (i.e., 3 symbols on the first reel×3 symbols on the second reel×3 symbols on the third reel). A four reel gaming device with three symbols generated in active symbol positions on each reel includes 81 ways to win (i.e., 3 symbols on the first reel×3 symbols on the second reel×3 symbols on the third reel×3 symbols on the fourth reel). A five reel gaming device with three symbols generated in active symbol positions on each reel includes 243 ways to win (i.e., 3 symbols on the first reel×3 symbols on the second reel×3 symbols on the third reel×3 symbols on the fourth reel×3 symbols on the fifth reel). It should be appreciated that modifying the number of generated symbols by either modifying the number of reels or modifying the number of symbols generated in active symbol positions by one or more of the reels, modifies the number of ways to win.

In another embodiment, the gaming device enables a player to wager on and thus activate symbol positions. In one such embodiment, the symbol positions are on the reels. In this embodiment, if based on the player's wager, a reel is activated, then each of the symbol positions of that reel will be activated and each of the active symbol positions will be part of one or more of the ways to win. In one embodiment, if based on the player's wager, a reel is not activated, then a designated number of default symbol positions, such as a single symbol position of the middle row of the reel, will be activated and the default symbol position(s) will be part of one or more of the ways to win. This type of gaming machine enables a player to wager on one, more or each of the reels and the processor of the gaming device uses the number of wagered on reels to determine the active symbol positions and the number of possible ways to win. In alternative embodiments, (1) no symbols are displayed as generated at any of the inactive symbol positions, or (2) any symbols generated at any inactive symbol positions may be displayed to the player but suitably shaded or otherwise designated as inactive.

In one embodiment wherein a player wagers on one or more reels, a player's wager of one credit may activate each of the three symbol positions on a first reel, wherein one default symbol position is activated on each of the remaining four reels. In this example, as described above, the gaming device provides the player three ways to win (i.e., 3 symbols on the first reel×1 symbol on the second reel×1 symbol on the third reel×1 symbol on the fourth reel×1 symbol on the fifth reel). In another example, a player's wager of nine credits may activate each of the three symbol positions on a first reel, each of the three symbol positions on a second reel and each of the three symbol positions on a third reel wherein one default symbol position is activated on each of the remaining two reels. In this example, as described above, the gaming device provides the player twenty-seven ways to win (i.e., 3 symbols on the first reel×3 symbols on the second reel×3 symbols on the third reel×1 symbol on the fourth reel×1 symbol on the fifth reel).

In one embodiment, to determine any award(s) to provide to the player based on the generated symbols, the gaming device individually determines if a symbol generated in an active symbol position on a first reel forms part of a winning symbol combination with or is otherwise suitably related to a symbol generated in an active symbol position on a second reel. In this embodiment, the gaming device classifies each pair of symbols which form part of a winning symbol combination (i.e., each pair of related symbols) as a string of related symbols. For example, if active symbol positions include a first cherry symbol generated in the top row of a first reel and a second cherry symbol generated in the bottom row of a second reel, the gaming device classifies the two cherry symbols as a string of related symbols because the two cherry symbols form part of a winning symbol combination.

After determining if any strings of related symbols are formed between the symbols on the first reel and the symbols on the second reel, the gaming device determines if any of the symbols from the next adjacent reel should be added to any of the formed strings of related symbols. In this embodiment, for a first of the classified strings of related symbols, the gaming device determines if any of the symbols generated by the next adjacent reel form part of a winning symbol combination or are otherwise related to the symbols of the first string of related symbols. If the gaming device determines that a symbol generated on the next adjacent reel is related to the symbols of the first string of related symbols, that symbol is subsequently added to the first string of related symbols. For example, if the first string of related symbols is the string of related cherry symbols and a related cherry symbol is generated in the middle row of the third reel, the gaming device adds the related cherry symbol generated on the third reel to the previously classified string of cherry symbols.

On the other hand, if the gaming device determines that no symbols generated on the next adjacent reel are related to the symbols of the first string of related symbols, the gaming device marks or flags such string of related symbols as complete. For example, if the first string of related symbols is the string of related cherry symbols and none of the symbols of the third reel are related to the cherry symbols of the previously classified string of cherry symbols, the gaming device marks or flags the string of cherry symbols as complete.

After either adding a related symbol to the first string of related symbols or marking the first string of related symbols as complete, the gaming device proceeds as described above for each of the remaining classified strings of related symbols which were previously classified or formed from related symbols on the first and second reels.

After analyzing each of the remaining strings of related symbols, the gaming device determines, for each remaining pending or incomplete string of related symbols, if any of the symbols from the next adjacent reel, if any, should be added to any of the previously classified strings of related symbols. This process continues until either each string of related symbols is complete or there are no more adjacent reels of symbols to analyze. In this embodiment, where there are no more adjacent reels of symbols to analyze, the gaming device marks each of the remaining pending strings of related symbols as complete.

When each of the strings of related symbols is marked complete, the gaming device compares each of the strings of related symbols to an appropriate paytable and provides the player any award associated with each of the completed strings of symbols. It should be appreciated that the player is provided one award, if any, for each string of related symbols generated in active symbol positions (i.e., as opposed to being based on how many paylines that would have passed through each of the strings of related symbols in active symbol positions).

In one embodiment, a base or primary game may be a poker game wherein the gaming device enables the player to play a conventional game of video draw poker and initially deals five cards all face up from a virtual deck of fifty-two card deck. Cards may be dealt as in a traditional game of cards or in the case of the gaming device, may also include that the cards are selected from a predetermined number of cards. If the player wishes to draw, the player selects the cards to hold via one or more input device, such as pressing related hold buttons or via the touch screen. The player then presses the deal button and the unwanted or discarded cards are removed from the display and the gaming machine deals the replacement cards from the remaining cards in the deck. This results in a final five-card hand. The gaming device compares the final five-card hand to a payout table which utilizes conventional poker hand rankings to determine the winning hands. The gaming device provides the player with an award based on a winning hand and the credits the player wagered.

In another embodiment, the base or primary game may be a multi-hand version of video poker. In this embodiment, the gaming device deals the player at least two hands of cards. In one such embodiment, the cards are the same cards. In one embodiment each hand of cards is associated with its own deck of cards. The player chooses the cards to hold in a primary hand. The held cards in the primary hand are also held in the other hands of cards. The remaining non-held cards are removed from each hand displayed and for each hand replacement cards are dealt into that hand. Since the replacement cards are dealt independently for each hand, the replacement cards for each hand will usually be different. The poker hand rankings are then determined hand by hand and awards are provided to the player.

In one embodiment, a base or primary game may be a keno game wherein the gaming device displays a plurality of selectable indicia or numbers on at least one of the display devices. In this embodiment, the player selects at least one or a plurality of the selectable indicia or numbers via an input device such as the touch screen. The gaming device then displays a series of drawn numbers to determine an amount of matches, if any, between the player's selected numbers and the gaming device's drawn numbers. The player is provided an award based on the amount of matches, if any, based on the amount of determined matches and the number of numbers drawn.

In one embodiment, in addition to winning credits or other awards in a base or primary game, the gaming device may also give players the opportunity to win credits in a bonus or secondary game or bonus or secondary round. The bonus or secondary game enables the player to obtain a prize or payout in addition to the prize or payout, if any, obtained from the base or primary game. In general, a bonus or secondary game produces a significantly higher level of player excitement than the base or primary game because it provides a greater expectation of winning than the base or primary game and is accompanied with more attractive or unusual features than the base or primary game. In one embodiment, the bonus or secondary game may be any type of suitable game, either similar to or completely different from the base or primary game.

In one embodiment, the triggering event or qualifying condition may be a selected outcome in the primary game or a particular arrangement of one or more indicia on a display device in the primary game, such as the number seven appearing on three adjacent reels along a payline in the primary slot game embodiment seen in FIGS. 1A and 1B. In other embodiments, the triggering event or qualifying condition may be by exceeding a certain amount of game play (such as number of games, number of credits, amount of time), or reaching a specified number of points earned during game play.

In another embodiment, the gaming device processor 12 or central server 56 provides the player one or more plays of one or more secondary games. In one such embodiment, the gaming device does not provide any apparent reasons to the player for qualifying to play a secondary or bonus game. In this embodiment, qualifying for a bonus game is not triggered by an event in or based specifically on any of the plays of any primary game. That is, the gaming device may simply qualify a player to play a secondary game without any explanation or alternatively with simple explanations. In another embodiment, the gaming device (or central server) qualifies a player for a secondary game at least partially based on a game triggered or symbol triggered event, such as at least partially based on the play of a primary game.

In one embodiment, the gaming device includes a program which will automatically begin a bonus round after the player has achieved a triggering event or qualifying condition in the base or primary game. In another embodiment, after a player has qualified for a bonus game, the player may subsequently enhance his/her bonus game participation through continued play on the base or primary game. Thus, for each bonus qualifying event, such as a bonus symbol, that the player obtains, a given number of bonus game wagering points or credits may be accumulated in a "bonus meter" programmed to accrue the bonus wagering credits or entries toward eventual participation in a bonus game. The occurrence of multiple such bonus qualifying events in the primary game may result in an arithmetic or exponential increase in the number of bonus wagering credits awarded. In one embodiment, the player may redeem extra bonus wagering credits during the bonus game to extend play of the bonus game.

In one embodiment, no separate entry fee or buy in for a bonus game need be employed. That is, a player may not purchase an entry into a bonus game, rather they must win or earn entry through play of the primary game thus, encouraging play of the primary game. In another embodiment, qualification of the bonus or secondary game is accomplished through a simple "buy in" by the player, for example, if the player has been unsuccessful at qualifying through other specified activities. In another embodiment, the player must make a separate side-wager on the bonus game or wager a designated amount in the primary game to qualify for the secondary game. In this embodiment, the secondary game triggering event must occur and the side-wager (or designated primary game wager amount) must have been placed to trigger the secondary game.

It should be appreciated that in one embodiment, regardless of how a selected predetermined game outcome (as described below) is ultimately presented to the player, either as a value or payout from the primary or base game, as a value or payout from a non-persistence secondary or bonus game, as a value or payout from a persistence secondary or bonus game, as a lose from the primary or base game or as a lose from the secondary or bonus game, the game outcome is predetermined. For example, if a particular game outcome in a $1 slot machine gaming device is a win outcome with an associated value or payout of $10, the outcome may be presented to the player as a $10 win outcome in the primary or base game, a $10 non-persistence secondary or bonus game win outcome or any combination of payouts in the primary or base game and secondary or bonus game that result in a total payout of $10. In one such embodiment, if the provided game outcome is a bonus or secondary game triggering outcome, the bonus or secondary game proceeds as described above. That is, in the bonus or secondary game, the gaming terminal randomly generates at least one random number and the central controller selects, as described above, an available secondary or bonus game outcome from a set or pool of bonus game outcomes based on the gaming terminal generated random number. It should be appreciated that the bonus game may proceed in any other suitable method.

Figure 2B:
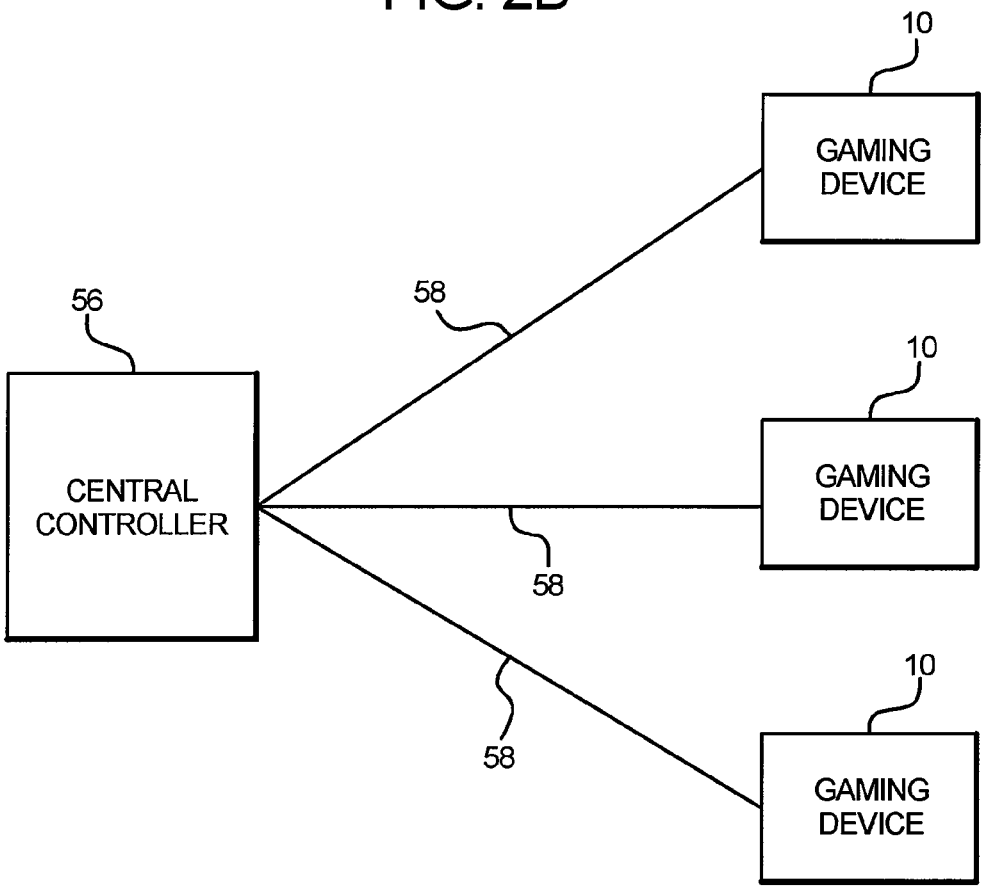
FIG. 2B is a schematic diagram of the central server in communication with a plurality of gaming machines in accordance with one embodiment of the gaming system disclosed herein.

In one embodiment, as illustrated in FIG. 2B, one or more of the gaming devices 10 are in communication with each other and/or at least one central server, central controller or remote host 56 through a data network or remote communication link 58. In this embodiment, the central server, central controller or remote host is any suitable server or computing device which includes at least one processor and at least one memory or storage device. In different such embodiments, the central server is a progressive controller or a processor of one of the gaming devices in the gaming system. In these embodiments, the processor of each gaming device is designed to transmit and receive events, messages, commands or any other suitable data or signal between the individual gaming device and the central server. The gaming device processor is operable to execute such communicated events, messages or commands in conjunction with the operation of the gaming device. Moreover, the processor of the central server is designed to transmit and receive events, messages, commands or any other suitable data or signal between the central server and each of the individual gaming devices. The central server processor is operable to execute such communicated events, messages or commands in conjunction with the operation of the central server. It should be appreciated that one, more or each of the functions of the central controller as disclosed herein may be performed by one or more gaming device processors. It should be further appreciated that one, more or each of the functions of one or more gaming device processors as disclosed herein may be performed by the central controller.

In another embodiment, one or more of the gaming devices are in communication with a central server or controller for monitoring purposes only. That is, each individual gaming device generates the game outcomes to be provided to the player and the central server or controller monitors the activities and events occurring on the plurality of gaming devices. In one embodiment, the gaming network includes a real-time or on-line accounting and gaming information system operably coupled to the central server or controller. The accounting and gaming information system of this embodiment includes a player database for storing player profiles, a player tracking module for tracking players and a credit system for providing automated casino transactions.

In one embodiment, the gaming device disclosed herein is associated with or otherwise integrated with one or more player tracking systems. Player tracking systems enable gaming establishments to recognize the value of customer loyalty through identifying frequent customers and rewarding them for their patronage. In one embodiment, the gaming device and/or player tracking system tracks any players gaming activity at the gaming device. In one such embodiment, the gaming device includes at least one card reader 38 in communication with the processor. In this embodiment, a player is issued a player identification card which has an encoded player identification number that uniquely identifies the player. When a player inserts their playing tracking card into the card reader to begin a gaming session, the card reader reads the player identification number off the player tracking card to identify the player. The gaming device and/or associated player tracking system timely tracks any suitable information or data relating to the identified player's gaming session. Directly or via the central controller, the gaming device processor communicates such information to the player tracking system. The gaming device and/or associated player tracking system also timely tracks when a player removes their player tracking card when concluding play for that gaming session. In another embodiment, rather than requiring a player to insert a player tracking card, the gaming device utilizes one or more portable devices carried by a player, such as a cell phone, a radio frequency identification tag or any other suitable wireless device to track when a player begins and ends a gaming session. In another embodiment, the gaming device utilizes any suitable biometric technology or ticket technology to track when a player begins and ends a gaming session.

During one or more gaming sessions, the gaming device and/or player tracking system tracks any suitable information or data, such as any amounts wagered, average wager amounts and/or the time these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In one embodiment, such tracked information and/or any suitable feature associated with the player tracking system is displayed on a player tracking display 40. In another embodiment, such tracked information and/or any suitable feature associated with the player tracking system is displayed via one or more service windows (not shown) which are displayed on the central display device and/or the upper display device.

In one embodiment, a plurality of the gaming devices are capable of being connected together through a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN) in which one or more of the gaming devices are in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system may be substantially identical to the LAN gaming system described above, although the number of gaming devices in each system may vary relative to each other.

In another embodiment, the gaming system disclosed herein is implemented via a data network, such as an internet or intranet. In one such embodiment, the operation of a gaming device can be viewed at the gaming device with at least one internet browser. In another such embodiment, the operation of a gaming device can be viewed at a location remote from the gaming device or gaming establishment utilizing at least one internet browser. In these embodiments, operation of the gaming device may be accomplished with only a connection to the central server or controller (i.e., an internet/intranet server) through a conventional phone or other data transmission line, digital subscriber line (DSL), T-1 line, coaxial cable, fiber optic cable, or other suitable connection. Accordingly, players may access an internet game page from any location where an internet connection and computer, or other internet facilitator is available. It should be appreciated that the expansion in the number of computers and number and speed of internet connections in recent years increases opportunities for players to play from an ever-increasing number of remote sites. It should be further appreciated that enhanced bandwidth of digital wireless communications may render such technology suitable for some or all communications, particularly if such communications are encrypted. Higher data transmission speeds may be useful for enhancing the sophistication and response of the display and interaction with the player.

In one embodiment, the central server (i.e., an internet/intranet server) maintains at least one dedicated gaming site which is associated with one or more progressive awards and one or more supplemental funds as disclosed herein. In operation, a player logs onto the dedicated gaming site and the central server enables the player to wager on and participate in one or more online games at this gaming site. In this embodiment, upon the occurrence of any progressive award increase event, the central server adds a value or amount (from the maintained supplemental fund) to one or more of the progressive awards associated with the dedicated gaming site.

In one embodiment, to regulate and monitor the play of games over the internet, player's identifications are verified through credit card authentication. Through this authentication, the gaming system verifies the player, the player's age, the player's location and any other suitable information associated with the player. In one such embodiment, the gaming system utilizes the verified location information to monitor and ensure that the player in a certain location follows any applicable gaming regulations associated with that location. In another such embodiment, the gaming system utilizes the verified location information to set up different progressive awards for different regions. In this embodiment, different progressive awards are allotted per region.

In another embodiment including game play over the internet, the gaming system stores information about one or more players. In this embodiment, after a player has enrolled or identified themselves with the gaming system (via the dedicated gaming site), the gaming system stores their information, such as credit card information, preferred options, player number, name, or any other information in a database. In one such embodiment, the gaming system enables the player to set and store one or more gaming options, such as jackpot betting, side wagering, and preferred games, associated with the dedicated gaming site.

As mentioned above, in one embodiment, the present disclosure may be employed in a server based gaming system. In one such embodiment, as described above, one or more gaming devices are in communication with a central server or controller. The central server or controller may be any suitable server or computing device which includes at least one processor and a memory or storage device. In alternative embodiments, the central server is a progressive controller or another gaming machine in the gaming system. In one embodiment, the memory device of the central server stores different game programs and instructions, executable by a gaming device processor, to control the gaming device. Each executable game program represents a different game or type of game which may be played on one or more of the gaming devices in the gaming system. Such different games may include the same or substantially the same game play with different pay tables. In different embodiments, the executable game program is for a primary game, a secondary game or both. In another embodiment, the game program may be executable as a secondary game to be played simultaneous with the play of a primary game (which may be downloaded to or static on the gaming device) or vice versa.

In this embodiment, each gaming device at least includes one or more display devices and/or one or more input devices for interaction with a player. A local processor, such as the above-described gaming device processor or a processor of a local server, is operable with the display device (s) and/or the input device(s) of one or more of the gaming devices.

In operation, the central controller is operable to communicate one or more of the stored game programs to at least one local processor. In different embodiments, the stored game programs are communicated or delivered by embedding the communicated game program in a device or a component (e.g., a microchip to be inserted in a gaming device), writing the game program on a disc or other media, downloading or streaming the game program over a dedicated data network, internet or a telephone line. After the stored game programs are communicated from the central server, the local processor executes the communicated program to facilitate play of the communicated program by a player through the display device(s) and/or input device(s) of the gaming device. That is, when a game program is communicated to a local processor, the local processor changes the game or type of game played at the gaming device.

In one embodiment, a plurality of gaming devices at one or more gaming sites are networked to the central server in a progressive configuration, wherein a portion of each wager placed is allocated to one or more progressive awards. In one embodiment, such progressive awards are associated with the system of gaming machines which each contribute portions of the progressive awards. In one such embodiment, different progressive awards are associated with different numbers of gaming devices. For example, a progressive award valued at $10,000 may be associated with ten gaming devices while another progressive award valued at $500,000 may be associated with one-hundred gaming devices. In one embodiment, the multiple gaming machines may be in the same bank of machines, in the same casino or gaming establishment such as through a LAN or in two or more different casinos or gaming establishments such as through a WAN. In another embodiment, each individual gaming machine maintains one or more progressive awards wherein a portion of each wager placed at that respective gaming machine is allocated to one or more progressive awards maintained by such individual gaming machine. In another embodiment, each individual gaming machine maintains one or more progressive awards and the central server simultaneously or substantially simultaneously maintains one or more progressive awards. In one such embodiment, the lower valued, more frequently triggered progressive awards are maintained by the individual gaming machines and the higher valued, less frequently triggered progressive awards are maintained by the central server.

In one embodiment, a host site computer is coupled to a plurality of the central servers at a variety of mutually remote gaming sites for providing a multi-site linked progressive automated gaming system. In one embodiment, a host site computer may serve gaming devices distributed throughout a number of properties at different geographical locations including, for example, different locations within a city or different cities within a state. In one embodiment, the host site computer is maintained for the overall operation and control of the system. In this embodiment, a host site computer oversees all or part of the progressive gaming system and is the master for computing all or part of the progressive jackpots. All participating gaming sites report to, and receive information from, the host site computer. Each central server computer is responsible for all data communication between the gaming device hardware and software and the host site computer.

In one embodiment, more than one of the progressive awards start at the same level, such as $1000 and increment or increase until provided to a player. In another embodiment, more than one of the progressive awards start at different levels such as $10, $100, $1000 and $10,000 and increment or increase until provided to a player. The progressive awards accumulate based on a small percentage (such as 0.1%) of coin-in or wagered amounts in a conventional manner. In one embodiment, the percentage that goes to each progressive award is equal (such as 0.1% to each of four progressive awards). At this accrual rate, player wagers totaling $1,000,000 are required for the progressive to reach $1000. In one embodiment, at least a fraction of this amount may be funded by the casino by using a starting value higher than zero to make the progressive awards attractive even after they are reset. In other embodiments, two or more of the progressive awards may be funded by different percentages. In these embodiments, the central server and/or individual gaming device processor continues to increase the progressive levels until a progressive award is provided to a player (upon the occurrence of a progressive award triggering event), at which point the progressive is reset and another progressive award starts incrementing from the appropriate default progressive award level. In another embodiment, one or more progressive awards increment a predetermined amount per game played. In one such embodiment, this incremental amount is partially funded by an amount of the wagers placed and is partially funded by an amount provided by a gaming establishment marketing or advertisement department. In different embodiments, the gaming establishment marketing or advertisement department provides a value or amount to the progressive award based on matching a percentage of wagers placed, a predetermined amount for each game played, an elapsed period of time, or any other suitable manner.

In another embodiment, two or more of the progressive awards may be funded at different temporal rates. In this embodiment, the different progressive awards are incremented or funded in different increments of time wherein until the progressive hits, a set amount is added to the progressive at each determined time increment. In another embodiment, two or more of the progressive awards may each be incremented or funded based on different incrementing factors or incrementors. In this embodiment, a first of the progressive awards may increment each time a first incrementing factor occurs and a second of the progressive awards may increment each time a second incrementing factor occurs, wherein the first incrementing factor and the second incrementing factor are different. Examples of incrementing factors could be a symbol-driven trigger in the base game, the player betting a maximum amount, a percentage of possible gaming machines being actively played or in active status, or any other suitable method for defining an incrementor.

In one embodiment, one or more of the progressive awards are funded, at least partially, via a side-bet or side-wager which the player may make (and which may be tracked via a side-bet meter). In one embodiment, one or more of the progressive awards are funded with only side-bets or side-wagers placed. In another embodiment, one or more of the progressive awards are funded based on player's wagers as described above as well as any side-bets or side-wagers placed. In another embodiment, one or more progressive awards are funded, at least partially, via an amount provided by one or more marketing and/or advertising departments, such as a casino's marketing department.

In one alternative embodiment, a minimum wager level is required for a gaming machine to qualify to be selected to obtain one of the progressive awards. In one embodiment, this minimum wager level is the maximum wager level for the primary game in the gaming machine. In another embodiment, no minimum wager level is required for a gaming machine to qualify to be selected to obtain one of the progressive awards.

In one embodiment, the central server or other central controller determines when one or more progressive award wins are triggered. In this embodiment, a central controller and an individual gaming machine work in conjunction with each other to determine when a progressive award win is triggered, for example through an individual gaming machine meeting a predetermined requirement or criteria established by the central controller. In another embodiment, an individual gaming machine may determine when one or more progressive award wins are triggered. In another embodiment, an individual gaming machine may determine when at least one progressive award win is triggered and the central controller determines when at least one progressive award win is triggered.

In one embodiment, different gaming devices in the gaming system have different progressive awards available to a player. In one such embodiment, different types of gaming devices are associated with different types of progressive awards based on the current configuration of the gaming system. In one embodiment, zero, one or more progressive awards may be associated with each of the gaming devices in the gaming system while zero, one or more different progressive awards may be associated with a plurality of, but not all of the gaming devices in the gaming system.

In one embodiment, at least one and preferably a plurality of the progressive awards maintained by the gaming system are provided to players of the linked gaming machines in an apparently random fashion as perceived by the players of these gaming machines. These progressive awards are distinguished from the awards that the gaming machines provide to the players for displayed winning outcomes in the plays of the primary wagering games, such as slot games, card games (e.g., poker, blackjack) or any other suitable game.

In one embodiment, the gaming devices do not provide any apparent reasons to the players for obtaining such progressive awards. In this embodiment, providing the progressive awards is not triggered by a displayed event in the primary game or based specifically on any of the displayed plays of any primary game or on any of the displayed plays of any secondary game of the gaming machines in the system. That is, these progressive awards are provided to the players without any explanation or alternatively with simple explanations.

In another embodiment, a plurality of players at a plurality of linked gaming devices in a gaming system participate in a group gaming environment. In one embodiment, a plurality of players at a plurality of linked gaming devices work in conjunction with one another, such as playing together as a team or group, to win one or more awards. In one such embodiment, any award won by the group is shared, either equally or based on any suitable criteria, amongst the different players of the group. In another embodiment, a plurality of players at a plurality of linked gaming devices compete against one another for one or more awards. In one such embodiment, a plurality of players at a plurality of linked gaming devices participate in a gaming tournament for one or more awards. In another embodiment, a plurality of players at a plurality of linked gaming devices play for one or more awards wherein an outcome generated by one gaming device affects the outcomes generated by one or more linked gaming devices.

Persistence Game with a Non-Retreating Accumulation Meter

Figure 3:
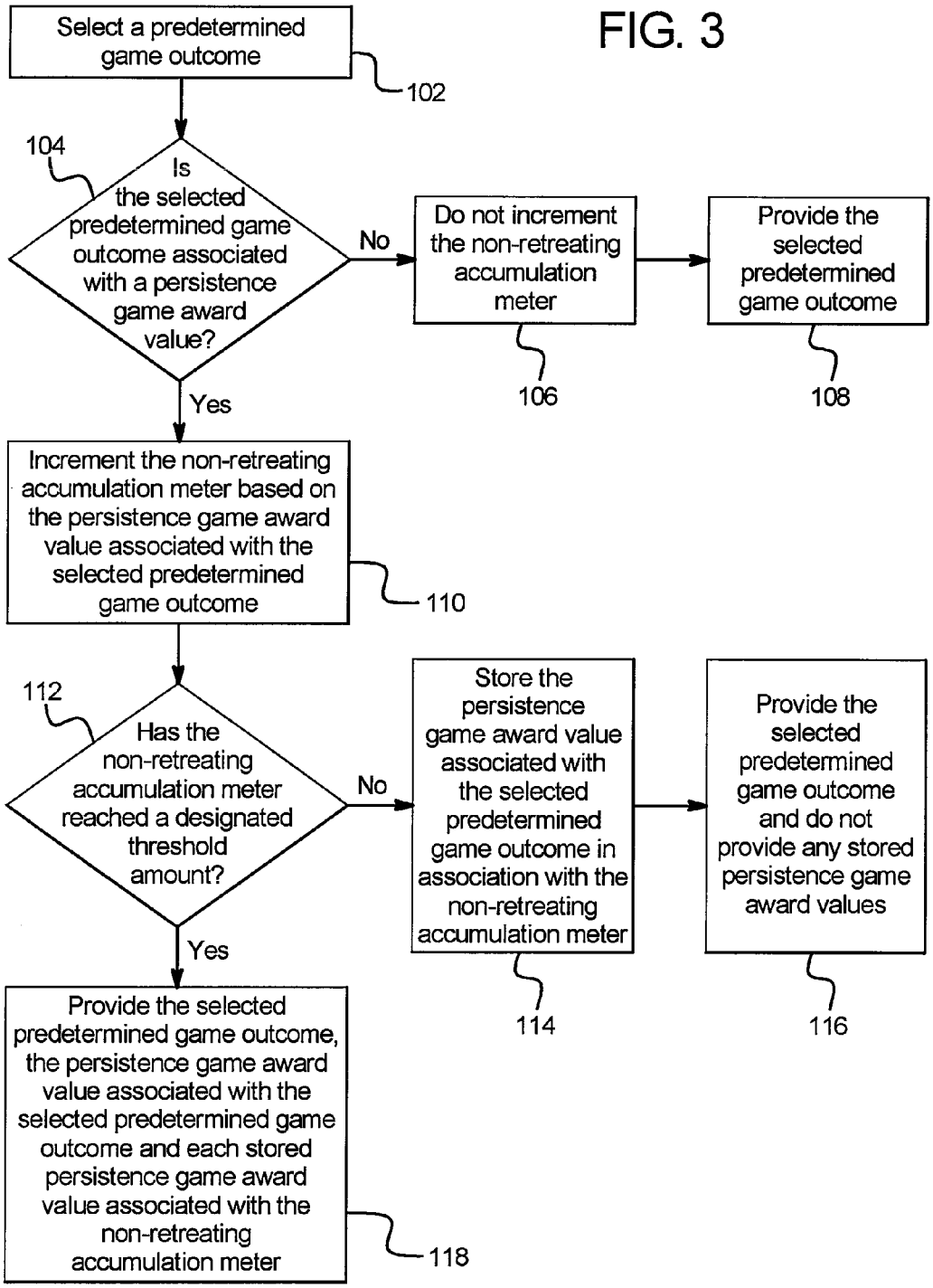
FIG. 3 is a flowchart of one embodiment of the gaming system disclosed herein illustrating one or more predetermined persistence game award values provided to a player via a persistence secondary game with a non-retreating accumulation meter.

Referring now to FIG. 3, one embodiment of the gaming system disclosed herein includes a persistence secondary game having a non-retreating accumulation meter or non-retreating accumulator. Such a non-retreating accumulation meter will not decrease or reset until the accumulation meter reaches a suitable threshold amount, a suitable threshold count or a suitable threshold level (i.e., a designated outcome has occurred a designated quantity of times) and a persistence secondary game award is provided to a player. In one such embodiment, upon the initiation of a play of a game at one of the gaming devices, the gaming system selects, obtains, receives or determines a predetermined game outcome as indicated in block 102.

In one embodiment, the central server or controller maintains one or more predetermined pools or sets of predetermined game outcomes. In this embodiment, upon a player initiating game play at one of the gaming devices, the initiated gaming device communicates a game outcome request to the central server or controller. The central server receives the game outcome request and independently obtains or selects a predetermined game outcome from a set or pool of game outcomes. In one such embodiment, the predetermined game outcomes are randomly shuffled or arranged in the pool prior to the first outcome being dispensed and the central controller obtains the next predetermined game outcome in the shuffled pool. In another such embodiment, the central controller randomly selects a not-yet-used outcome within the pool for each outcome requested. In another such embodiment, the predetermined game outcomes are randomly shuffled or arranged in the pool prior to the first outcome being dispensed and the central controller randomly selects a not-yet-used outcome within the pool for each outcome requested. In these embodiments, the central server or controller flags or marks the obtained or selected game outcome as used. Once a game outcome is flagged as used, it is prevented from further selection from the set or pool and cannot be selected by the central controller or server upon another wager.

In an alternative embodiment, the central controller maintains at least one set or pool of game outcome seeds. Each game outcome seed is a unique random number seed which is deterministic of a predetermined game outcome. In this embodiment, as described above, the central controller selects one or more game outcome seeds from the set or pool of game outcome seeds. The central controller flags the selected predetermined game outcome seed(s) as unavailable and communicates the selected predetermined game outcome seed(s) to the gaming device. The gaming device utilizes the selected predetermined game outcome seed(s) in one or more random number generating algorithms to generate the selected predetermined game outcome. It should be appreciated that in this embodiment, if any one or more than one designated gaming devices configured for playing a certain game receive the same specific game outcome seed, the resulting predetermined game outcome will always be the same even though the different gaming devices operate independently from one another. That is, if a plurality of the same gaming devices each run the same game outcome seed through one or more predefined random number generating algorithms, each of such same gaming devices will generate the same series of random numbers that correspond to the same predetermined game outcomes.

In another embodiment, a predetermined game outcome is obtained for each of a plurality of linked or networked gaming devices based on the results of a bingo, keno or lottery game. In this embodiment, each individual gaming device utilizes one or more bingo, keno or lottery games to determine a predetermined game outcome provided to the player for the initiated game played at that gaming device. In one embodiment, the bingo, keno or lottery game is displayed to the player. In another embodiment, the bingo, keno or lottery game is not displayed to the player, but the results of the bingo, keno or lottery game determine the selected predetermined game outcome for the initiated game.

In the various bingo embodiments, as each gaming device is enrolled in the bingo game, such as upon an appropriate wager or engaging an input device, the enrolled gaming device is provided or associated with a different bingo card. Each bingo card consists of a matrix or array of elements, wherein each element is designated with a separate indicia, such as a number. It should be appreciated that each different bingo card includes a different combination of elements. For example, if four bingo cards are provided to four enrolled gaming devices, the same element may be present on all four of the bingo cards while another element may solely be present on one of the bingo cards.

In operation of these embodiments, upon providing or associating a different bingo card to each of a plurality of enrolled gaming devices, the central controller randomly selects or draws, one at a time, a plurality of the elements. As each element is selected, a determination is made for each gaming device as to whether the selected element is present on the bingo card provided to that enrolled gaming device. This determination can be made by the central controller, the gaming device, a combination of the two, or in any other suitable manner. If the selected element is present on the bingo card provided to that enrolled gaming device, that selected element on the provided bingo card is marked or flagged. In one such embodiment, this process of selecting elements and marking any selected elements on the provided bingo cards continues until one or more predetermined patterns are marked on one or more of the provided bingo cards. In another such embodiment, this process of selecting elements and marking any selected elements on the provided bingo cards continues until a designed number of element have been selected. It should be appreciated that in one embodiment, the gaming device requires the player to engage a daub button (not shown) to initiate the process of the gaming device marking or flagging any selected elements.

After one or more predetermined patterns are marked on one or more of the provided bingo cards, a game outcome is determined for each of the enrolled gaming devices based, at least in part, on the selected elements on the provided bingo cards. As described above, the game outcome determined for each gaming device enrolled in the bingo game is utilized by that gaming device to determine or select the predetermined game outcome provided to the player. For example, a first gaming device to have selected elements marked in a predetermined pattern is provided a first outcome of win $10 which will be provided to a first player regardless of how the first player plays in a first game and a second gaming device to have selected elements marked in a different predetermined pattern is provided a second outcome of win $2 which will be provided to a second player regardless of the play of a second game. It should be appreciated that as the process of marking selected elements continues until one or more predetermined patterns are marked, this embodiment ensures that at least one bingo card will win the bingo game and thus at least one enrolled gaming device will provide a predetermined winning game outcome to a player. It should be appreciated that other suitable methods for selecting or determining one or more predetermined game outcomes may be employed.

In one example of the above-described embodiment, the predetermined game outcome may be based on a supplemental award in addition to any award provided for winning the bingo game as described above. In this embodiment, if one or more elements are marked in supplemental patterns within a designated number of drawn elements, a supplemental or intermittent award or value associated with the marked supplemental pattern is provided to the player as part of the predetermined game outcome. For example, if the four corners of a bingo card are marked within the first twenty selected elements, a supplemental award of $10 is provided to the player as part of the predetermined game outcome. It should be appreciated that in this embodiment, the player of a gaming device may be provided a supplemental or intermittent award regardless of if the enrolled gaming device's provided bingo card wins or does not win the bingo game as described above.

In one embodiment, each selected predetermined game outcome includes a game outcome component (i.e., a win, or a lose) with an associated primary game outcome value or payout amount, if any, and a game presentation component (i.e., how the game outcome is displayed or presented to the player). In this embodiment, zero, one or more selected predetermined game outcomes are also associated with a persistence game award value. A persistence game award value is an amount or value which is provided to a player upon the completion of a persistence game, regardless of if that persistence game is completed in association with the selection of the predetermined game outcome in association with a current play of a game or in association with the subsequent selection of another predetermined game outcome in association with a subsequent play of a game.

In another embodiment wherein the gaming system enables a player to wager different wager amounts per payline, the gaming system utilizes different pools of predetermined game outcomes for the different wager amounts. In another embodiment wherein the gaming system enables a player to wager different wager amounts per payline, the gaming system utilizes the same pool of predetermined game outcomes irrespective of the wager amount. In this embodiment, rather than the predetermined game outcomes having static primary game outcome values, each predetermined game outcome has a dynamic primary game outcome values which is determined based on a primary game outcome multiplier of the predetermined game outcome applied to the player's amount wagered. In this embodiment, upon the gaming system selecting a predetermined game outcome having a persistence game award value, the gaming system accounts for the player's wager amount when increasing the accumulation meter as described below.

After selecting, determining or receiving the predetermined game outcome, the gaming system determines if the selected predetermined game outcome includes a persistence game award value as indicated in diamond 104 of FIG. 3. If the selected predetermined game outcome is not associated with a persistence game award value, then as indicated in block 106, the gaming system does not increment or increase the non-retreating accumulator or accumulation meter of the persistence secondary game. Additionally, if the selected predetermined game outcome is not associated with a persistence game award value, the gaming system provides the selected predetermined game outcome to the player as indicated in block 108.

Figure 4A:
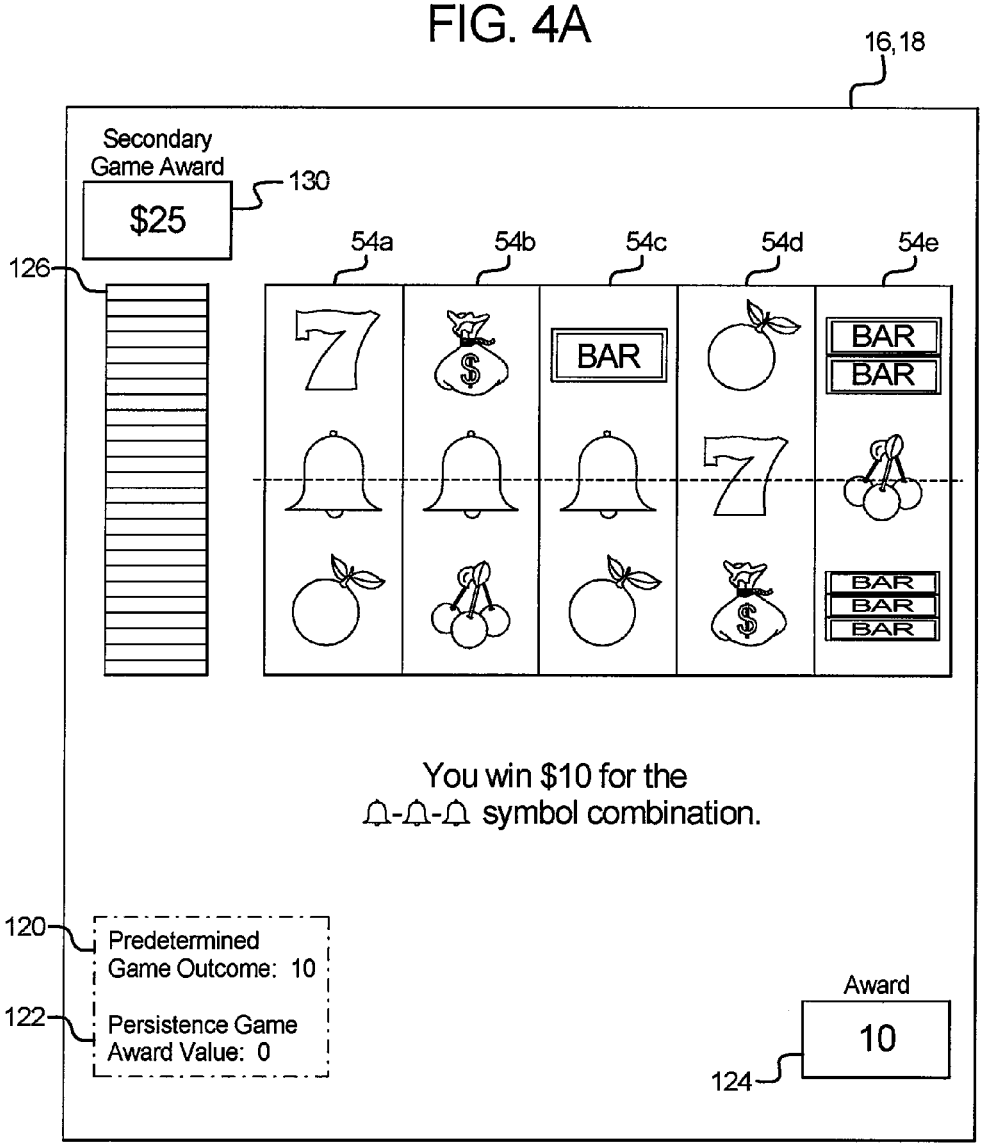
FIGS. 4A, 4B and 4C are enlarged elevation views of different embodiments of the display of a gaming device of the gaming system disclosed herein illustrating a non-retreating accumulation meter of a persistence secondary game being filled until one or more persistence game award values are provided to a player.

For example, as displayed in FIG. 4A, a selected predetermined game outcome is associated with a win $10 game outcome component 120 and is not associated with any persistence game award value 122. It should be appreciated that the selected predetermined game outcome shown in FIG. 4A is for illustration purposes only and not actually displayed to the player. In this example, upon determining that the selected predetermined game outcome is not associated with any persistence game award value, the gaming system provides the selected $10 winning game outcome to the player (presented to the player as a bell symbol-bell symbol-bell symbol winning symbol combination and indicated by the award display 124) and leaves the non-retreating accumulation meter 126 unchanged. Appropriate messages such as "YOU WIN $10 FOR THE BELL-BELL-BELL SYMBOL COMBINATION" may be provided to the player visually, or through suitable audio or audiovisual displays.

On the other hand, if the selected predetermined game outcome includes a persistence game award value, then as indicated in block 110 of FIG. 3, the gaming system increments or increases the non-retreating accumulation meter based on the persistence game award value of the selected predetermined game outcome. For example, as displayed in FIG. 4B, a selected predetermined game outcome is associated with a win $10 game outcome component 120 and is also associated with a persistence game award value of $3 122. In this example, the gaming system displays the persistence game award value of $3 as a $2 persistence game award value sub-symbol 128*a* and a $1 persistence game award value sub-symbol 128*b* and increments the non-retreating accumulation meter 126 by three levels or steps to reflect the generated persistence game award value sub-symbols. It should be appreciated that in this illustrated example, each increment level of the non-retreating accumulation meter is associated with a persistence game award value of $1 and the three incremented levels of the non-retreating accumulation meter corresponds to the persistence game award value of $3. Appropriate messages such as "YOU WIN $10 FOR THE BELL-BELL-BELL SYMBOL COMBINATION" and "YOU ARE ALSO THREE STEPS CLOSER TO A SECONDARY GAME AWARD OF $25" may be provided to the player visually, or through suitable audio or audiovisual displays.

Following the increase to the non-retreating accumulation meter, the gaming system determines if the non-retreating accumulation meter has reached a threshold amount as indicated in diamond 112 of FIG. 3. That is, the gaming system determines whether or not to provide the player any persistence game award values in association with a winning outcome in the play of the ongoing persistence secondary game.

Figure 4B:
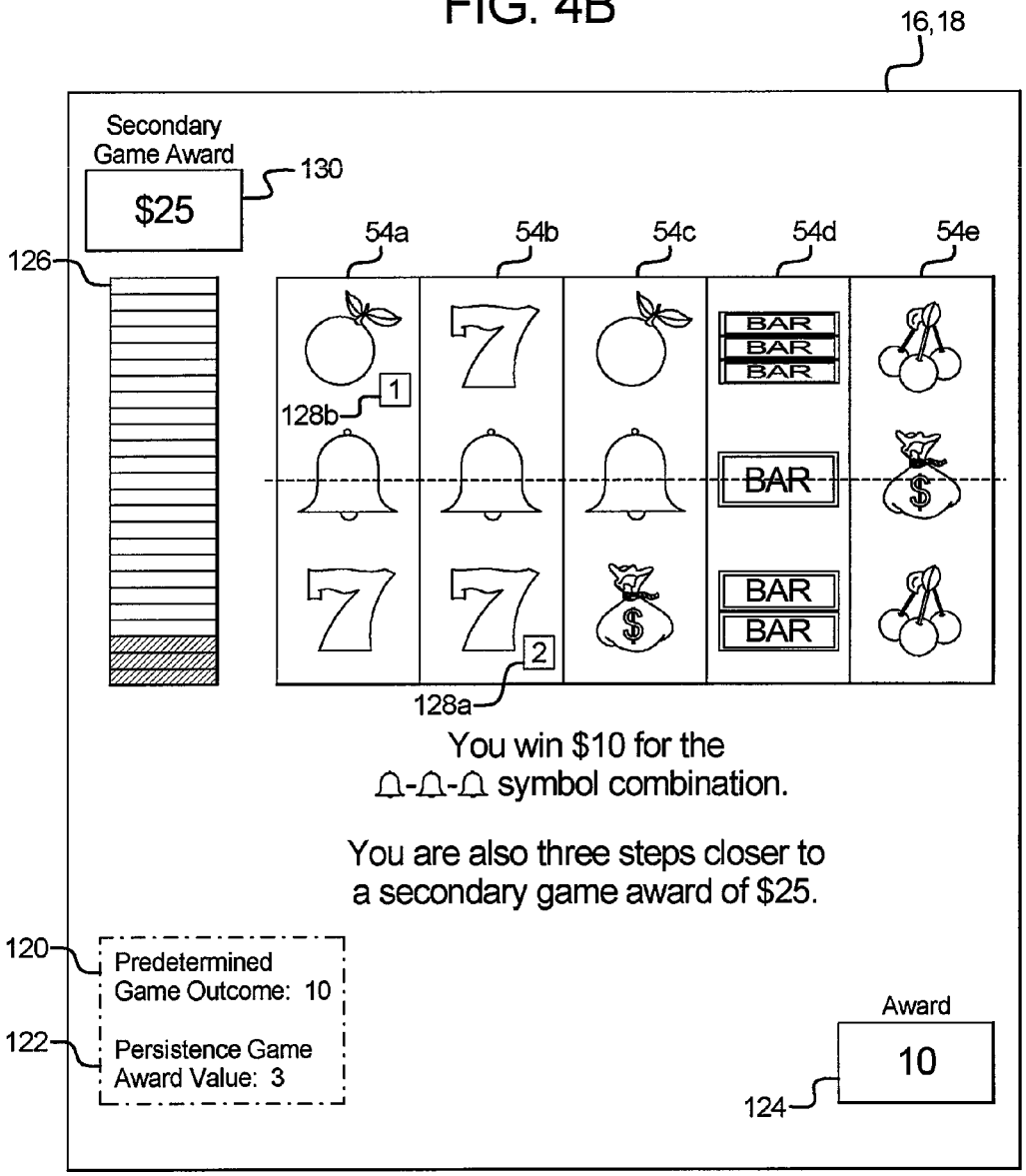

If the non-retreating accumulation meter has not reached a threshold amount, then the gaming system stores the persistence game award value of the selected predetermined game outcome in association with the non-retreating accumulation meter as indicated in block 114. Following the storage of this persistence game award value, the gaming system provides the selected predetermined game outcome and does not provide any stored persistence game award values as indicated in block 116. For example, as seen in FIG. 4B, the non-retreating accumulation meter 126 has twenty-five increment levels (associated with an award of $25 130). In another embodiment (not shown), the award associated with the non-retreating accumulation meter is masked or otherwise unknown to the player. As further seen in FIG. 4B, since the persistence game award value of $3 does not cause the non-retreating accumulation meter 126 to reach the designated threshold amount or level (i.e., the twenty-fifth level of the accumulation meter), the gaming system stores this persistence game award value of $3 (in association with the non-retreating accumulation meter). Thus, in this example, the gaming system does not currently provide the persistence game award value of $3 to the player, but rather stores this persistence game award value in association with the non-retreating accumulation meter and awaits for the selection of another predetermined game outcome associated with another persistence game award value as described below. In addition to storing the persistence game award value of $3 associated with the selected predetermined game outcome, the gaming system of this example provides the selected $10 winning game outcome to the player (presented to the player as a bell symbol—bell symbol—bell symbol winning symbol combination and indicated by the award display 124).

Figure 4C:
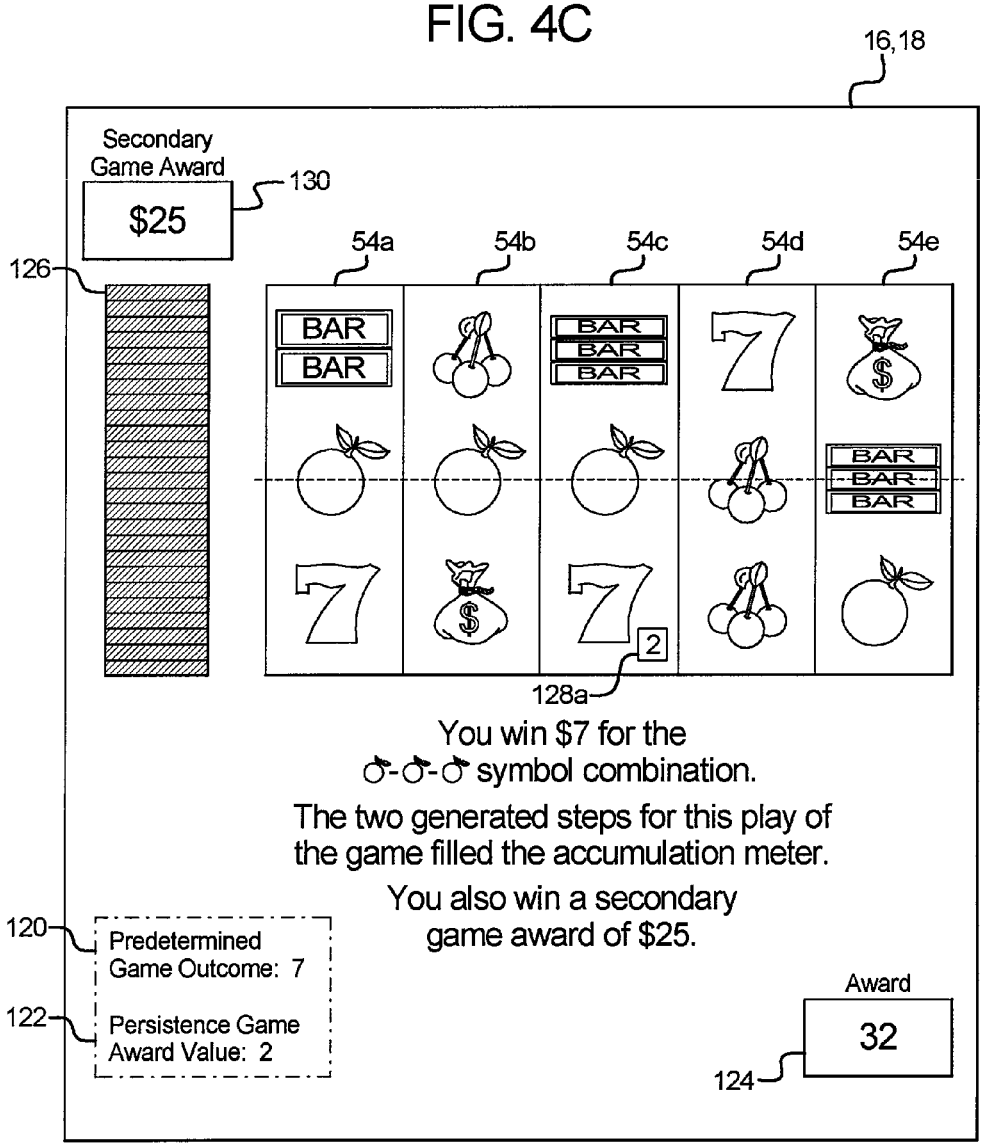

On the other hand, if the non-retreating accumulation meter has reached a threshold amount, then as indicated in diamond 118 of FIG. 3, the gaming system provides: (i) the selected predetermined game outcome, (ii) the persistence game award value of the selected predetermined game outcome and (iii) each stored persistence game award value associated with the non-retreating accumulation meter. For example, as displayed in FIG. 4C, for a subsequent play of a primary game, a selected predetermined game outcome is associated with a win $7 game outcome component 120 and a persistence game award value of $2 122. In this example, the gaming system displays the persistence game award value of $2 as a $2 persistence game award value sub-symbol 128*c* and increments the non-retreating accumulation meter 126 by two levels or steps. This increase to the accumulation meter causes the non-retreating accumulation meter to reach the designated threshold amount or level (i.e., the twenty-fifth level of the accumulation meter). Since the incremented non-retreating accumulation meter is associated with $25 of persistence game award values (i.e., $23 of stored persistence game award values associated with selected predetermined game outcomes from previous plays of the primary game and a persistence game award value of $2 of the selected predetermined game outcome for the current play of the primary game), the gaming system provides to a player the persistence game award value of $25. In addition to providing the secondary persistence game award value of $25 to the player, the gaming system of this example provides the selected $7 winning game outcome to the player (presented to the player as an orange symbol—orange symbol—orange winning symbol combination) to result in a total provided award of $32 displayed in the award display 124. Appropriate messages such as "YOU WIN $7 FOR THE ORANGE-ORANGE-ORANGE SYMBOL COMBINATION", "THE TWO GENERATED STEPS FOR THIS PLAY OF THE GAME FILLED THE ACCUMULATION METER" and "YOU ALSO WIN A SECONDARY GAME AWARD OF $25" may be provided to the player visually, or through suitable audio or audiovisual displays.

It should be appreciated that in this embodiment, regardless of whether a persistence game award value of a predetermined game outcome is provided to a player in association with a current play of a game or banked to be provided to that player (or another player) in association with a subsequent play of a game, the gaming system disclosed herein accounts for this persistence game award value as provided to one of the players of one of the gaming devices in the gaming system. For example, regardless of if a persistence game award value of $3 is provided to a first player in association with a first play of a game (i.e., the persistence game award value of $3 caused the non-retreating accumulation meter to reach the designated threshold amount) or provided to a second, different player in association with a subsequent play of a game (i.e., the persistence game award value of $3 increased the non-retreating accumulation meter toward but not to the designated threshold amount), the gaming system considers the persistence game award value of $3 as provided (even if which player that the persistence game award value of $3 is provided to is undetermined).

It should be appreciated that in one embodiment where each gaming device is associated with a separate persistence game, the player that is ultimately provided the persistence game award value may be: (i) a player that was playing the gaming device when the predetermined game outcome having the persistence game award value was selected in association of a first play of that gaming device, or (ii) another player that was subsequently playing the gaming device when the gaming system determined to provide the persistence game award value to the current player of the gaming device. It should be further appreciated that in another embodiment where a plurality of gaming devices are each associated with a community or multi-player persistence game, the player that is ultimately provided the persistence game award value may be: (i) a player that was playing a first gaming device when the predetermined game outcome having the persistence game award value was selected in association with a play of that first gaming device, (ii) another player that was playing a second gaming device when the predetermined game outcome having the persistence game award value was selected in association with the play of the first gaming device, (iii) another player that was subsequently playing the first gaming device when the gaming system determined to provide the persistence game award value to the current player of the first gaming device, or (iv) another player that was subsequently playing the second gaming device when the gaming system determined to provide the persistence game award value to the current player of the second gaming device. In another embodiment, each player is associated with a separate persistence game which is tracked in association with that player's tracking card. In this embodiment, any accumulated, non-provided persistence game award values are stored in association with that player's tracking card such that when any stored persistence game award values are ultimately provided, such stored persistence game award values are provided to that player.

In an alternative embodiment, if the non-retreating accumulation meter has reached beyond the threshold amount (i.e., the selected predetermined game outcome includes a persistence game award value that caused the non-retreating accumulation meter to increase past the threshold amount), the gaming system provides this surplus persistence game award value to the player in addition to (i) the selected predetermined game outcome, (ii) the persistence game award value of the selected predetermined game outcome and (iii) each stored persistence game award value associated with the non-retreating accumulation meter. In another alternative embodiment, if the non-retreating accumulation meter has reached beyond the threshold amount, the gaming system banks or rolls over this surplus persistence game award value an provides to the player (i) the selected predetermined game outcome, (ii) the persistence game award value of the selected predetermined game outcome and (iii) each stored persistence game award value associated with the non-retreating accumulation meter.

In another embodiment (not shown), if a selected predetermined game outcome includes a persistence game award value, the gaming system increments the non-retreating accumulation meter as described above. In this embodiment, if such an increment of the non-retreating accumulation meter has not caused the accumulation meter to reach the designated threshold amount, then for one or more subsequent plays of the primary game, the gaming system will randomly increment the non-retreating accumulation meter. That is, rather than only incrementing the accumulation meter upon the selection of a predetermined game outcome including a persistence game award value, if at least one persistence game award value is stored, then for one or more subsequent games played, the gaming system randomly determines whether to increment or increase the accumulation meter. In this embodiment, if the gaming system randomly determines to increment the accumulation meter (and randomly determines how much to increment the accumulation meter) and such an increment causes the accumulation meter to reach the designated threshold amount, the gaming system provides a player each of the stored persistence game award values associated with the accumulation meter. In another embodiment, if an increment of the non-retreating accumulation meter has not caused the accumulation meter to reach the designated threshold amount, the gaming system provides a player one or more opportunities to win one or more of the stored persistence game award values associated with the accumulation meter.

In one example of this embodiment, if the accumulation meter is two levels or steps away from the threshold level and the selected predetermined game outcome is not associated with a persistence game award value, the gaming system randomly determines an amount of one or more levels or steps to increment the accumulation meter. In this example, if the gaming system randomly determines to increment the accumulation meter by two levels (i.e., to the threshold level), the gaming system provides each of the stored persistence game award values associated with the accumulation meter to the player. It should be appreciated that in this embodiment, rather than associating each level of the accumulation meter with a value and displaying the value of the secondary game award which would be provided to the player upon filling the accumulation meter, the gaming system does not display to the player a value for filling the accumulation meter until the accumulation meter is fill. Thus, if an accumulation meter is partially filled in response to predetermined game outcomes having persistence game award values being selected and partially filled in response to random increases of the accumulation meter, the gaming system will only provide the stored persistence game award values to the player. In other words, at least one accumulation meter level is associated with a persistence game award value which is ultimately provided to a player and at least one accumulation meter level is not associated with any award values and thus no award values are provided to the player in association with these accumulation meter levels.

In one embodiment wherein the gaming system randomly determines whether to increment the accumulation meter, as the accumulation meter advances toward the threshold level, the probability of the gaming system randomly incrementing the accumulation meter remains unchanged regardless of the status of the accumulation meter. In one embodiment wherein the gaming system randomly determines whether to increment the accumulation meter, as the accumulation meter advances toward the threshold level, the probability of the gaming system randomly incrementing the accumulation meter changes based on the status of the accumulation meter. In one such embodiment, the closer the accumulation meter advances toward the threshold level, the lower the probability that the gaming system will randomly increment the accumulation meter. This embodiment provides that initial advancements of the accumulation meter, on average, come quickly while later advancements of the accumulation meter take longer. In another such embodiment, the closer the accumulation meter advances toward the threshold level, the greater the probability that the gaming system will randomly increment the accumulation meter. This embodiment provides that initial advancements of the accumulation meter, on average, take longer while later advancements of the accumulation meter come quickly.

In another embodiment, in addition to utilizing the persistence game award values of the selected predetermined game outcome to increment the non-retreating accumulation meter, the gaming system utilizes part or all of the value associated with the game outcome component of the selected predetermined game outcome to increment the non-retreating accumulation meter. In this embodiment, any portion of the value associated with the game outcome component of the selected predetermined game outcome not utilized to increment the non-retreating accumulation meter is provided to the player as a primary game award. For example, if a selected predetermined game outcome is associated with a win $10 game outcome component and is also associated with a persistence game award value of $3, in addition to incrementing the accumulation meter to account for the persistence game award value of $3, the gaming system utilizes the win $10 game outcome component to increment the accumulation meter (i.e., the accumulation meter is incremented by $13). In this example, since the $10 game outcome component of the selected predetermined game outcome is utilized or otherwise converted to increment the accumulation meter, the player is not provided this $10 game outcome component as a primary game award. In another example, if a selected predetermined game outcome is associated with a win $10 game outcome component and is also associated with a persistence game award value of $3, in addition to incrementing the accumulation meter to account for the persistence game award value of $3, the gaming system utilizes $5 of the game outcome component to increment the accumulation meter (i.e., the accumulation meter is incremented by $8) and provides the player a $5 primary game award.

In another embodiment, the gaming system utilizes a rapid accumulation meter advancement function. In one such embodiment, while certain outcomes advance the accumulator one step, another type of outcome advances the accumulator two or more steps. In different embodiments, the amount the accumulator is advanced with the rapid advancement feature is a static number or a randomly determined number.

In one example of a gaming system utilizing a rapid accumulation meter advancement function, a mini-game is played wherein the unfilled accumulator levels rapidly light up, either one at a time in a random fashion, or as a growing and shrinking set of lights from lowest to highest. In this example, the player is prompted to press a button and/or touch a touch screen which will stop the light sequence. In the case of a one-at-a-time implementation, one of the levels in the unfilled accumulator level will remain lit to define the new level of the accumulator, wherein the levels in between this level and the previous highest accumulated level are filled. In the case of a plurality of levels being lit wherein there are unlit levels between lit levels, when the lighting sequences finishes, all levels filled up to the new high accumulation level will be lit. Such an example provides the player two mechanisms for filling the accumulation meter. That is, sometimes the accumulator will increment piecemeal based upon a selected predetermined game outcome, while other times, the accumulator will increment to the top based on the selection of a single predetermined game outcome. It should be appreciated that in these example, though it may appear to the player that the timing of his input affected the selection, this is actually a pseudo-skill feature that will produce a result predetermined by the gaming system.

Persistence Game with a Retreating Accumulation Meter

One embodiment of the gaming system disclosed herein includes a persistence secondary game having a retreating accumulation meter or retreating accumulator. Such a retreating accumulation meter increases upon one or more suitable random events occurring but also decreases if one or more suitable random events do not occur. In one example embodiment of a gaming system including a retreating accumulation meter, the gaming system includes a primary game which provides a predetermined game outcome to the player, wherein the predetermined game outcome is either a winning game outcome having a value, a first type of losing game outcome, or a second type of losing game outcome. In this example embodiment, the gaming system further includes a persistence secondary game which utilizes a retreating accumulation meter to provide a player a predetermined persistence game award value. In the persistence secondary game, the gaming system increases the retreating accumulation meter based on the same type of losing game outcome (as the type of losing game outcome previously provided) being repeatedly provided in subsequent plays of the primary game. In the persistence secondary game, the gaming system decreases or otherwise empties or resets the retreating accumulation meter based on a different type of losing game outcome (than the type of losing game outcome previously provided) being provided in a subsequent play of the primary game. For example, if the gaming system provides a player the first type of losing game outcome for a first play of the primary game, the gaming system will associate the accumulation meter with this first type of losing game outcome and increase the accumulation meter according. In this example, if the gaming system subsequently provides a player the first type of losing game outcome for a second play of the primary game, since the accumulation meter is already associated with the first type of losing game outcome from the first play of the primary game, the gaming system will increase the accumulation meter to account for the second generation of the first type of losing game outcome. On the other hand, if the gaming system subsequently provides a player the second type of losing game outcome for a second play of the primary game, since the accumulation meter is already associated with the first type of losing game outcome from the first play of the primary game, the gaming system will reset or empty the accumulation meter, associate the accumulation meter with this second type of losing game outcome and increase the accumulation meter according.

Referring now to FIG. 5A, in one such embodiment, upon the initiation of a play of a game at one of the gaming devices, the gaming system selects, receives or determines a predetermined game outcome as indicated in block 202. As described above, each predetermined game outcome includes a game outcome component (i.e., a win or a lose) with an associated primary game outcome value or payout amount, if any, and a game presentation component (i.e., how the game outcome is displayed or presented to the player). As further described above, zero, one or more predetermined game outcomes also include a persistence game award value.

After selecting, determining or receiving the predetermined game outcome, the gaming system determines if a persistence game award value is previously stored as indicated in diamond 204. If a persistence game award value is not previously stored, the gaming system determines if the selected predetermined game outcome includes a persistence game award value as indicated in diamond 206. If the selected predetermined game outcome does not include a persistence game award value, the gaming system determines if the game presentation component of the selected predetermined game outcome would cause the accumulation meter to reach a threshold amount as indicated in diamond 208.

If the gaming system determines that the game presentation component of the selected predetermined game outcome would not cause the accumulation meter to reach the threshold amount, as indicated in block 210, the gaming system: (i) provides the game outcome component of the selected predetermined game outcome, (ii) displays the game presentation component of the selected predetermined game outcome and (iii) if applicable, increments the accumulation meter. That is, after determining that a persistence game award value is not previously stored and also determining that the selected predetermined game outcome does not include a persistence game award value, the gaming system determines that based on the current status of the retreating accumulation meter and the game presentation component of the selected predetermined game outcome, the game presentation component of the selected predetermined game outcome would not cause the accumulation meter to reach the threshold amount. Accordingly, the gaming system enables the player to play a primary game wherein regardless of the player's actions in the game, the game presentation of the selected predetermined game outcome will be displayed to the player, the selected predetermined game outcome will be provided to the player, and no persistence secondary game award will be provided to the player.

Figure 6A:
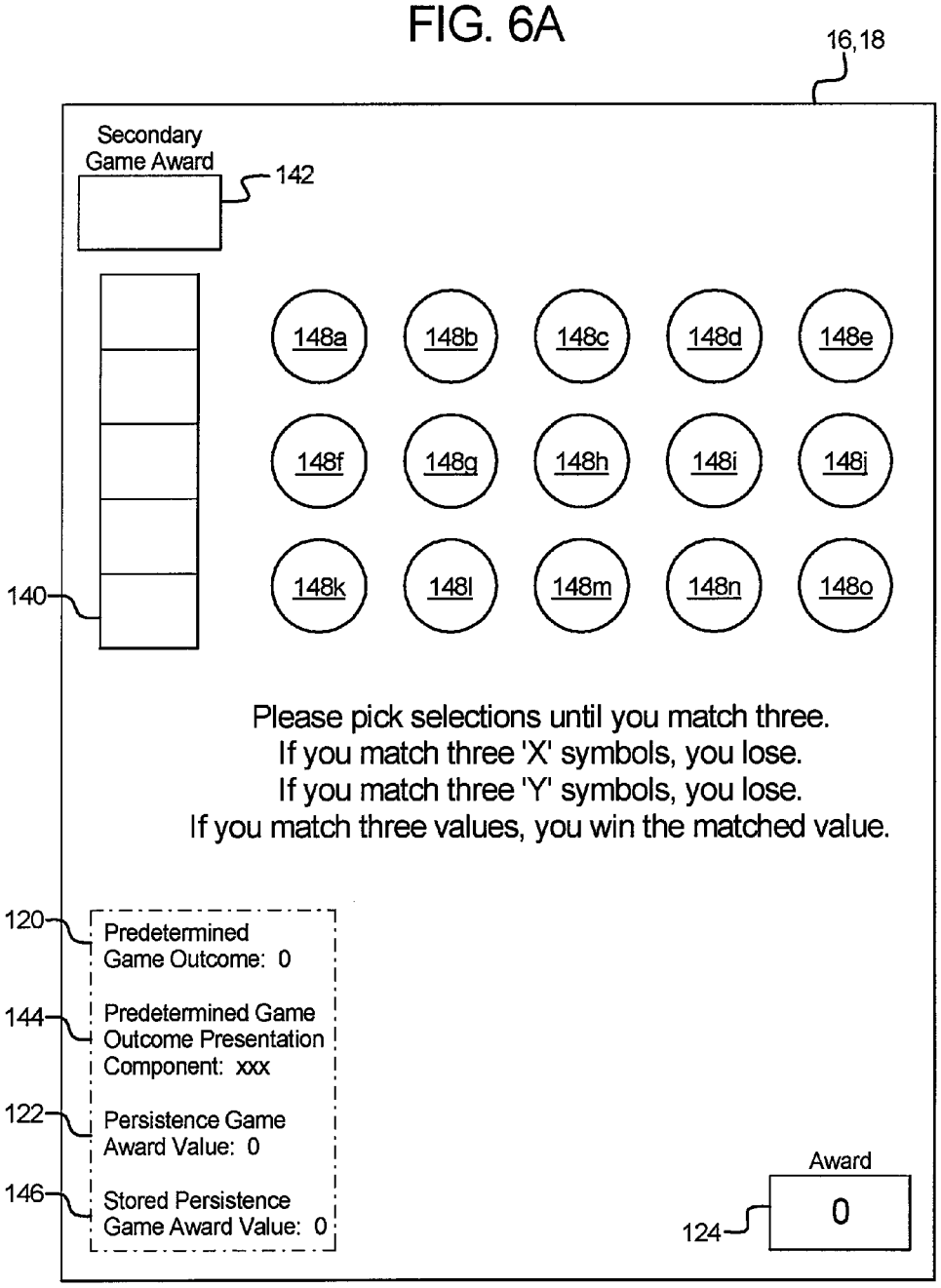
FIGS. 6A, 6B, 6C, 6D and 6E are enlarged elevation views of different embodiments of the display of a gaming device of the gaming system disclosed herein illustrating a persistence secondary game which utilizes a retreating accumulation meter to provide predetermined game outcomes.

For example, FIG. 6A illustrates a gaming system which utilizes the primary game to provide a predetermined game outcome to the player. The predetermined game outcome is either a winning game outcome having a value, a type of losing game outcome which is illustrated using three X symbols, or a second type of losing game outcome which is illustrated using three Y symbols. As illustrated in FIG. 6A, the gaming system further includes a persistence secondary game which utilizes a retreating accumulation meter 140 that is associated with a secondary game award 142 (which is not displayed to the player because it is determined based on the selection and storage of a persistence game award value as described below). The retreating accumulation meter includes a plurality of steps or levels. In this example, a predetermined losing game outcome 120 with a first type of game presentation component (i.e., a three X symbol losing presentation 144) is selected. Based on this selected predetermined losing game outcome and the current status of the retreating accumulation meter (i.e., the accumulation meter is not currently incremented nor are any persistence game award values associated with the accumulation meter), the gaming system determines that the game presentation component of the selected predetermined losing game outcome will be displayed to the player, the selected predetermined game outcome will be provided to the player, and no persistence secondary game award will be provided to the player regardless of any player actions in the game. Appropriate messages such as "PLEASE PICK SELECTIONS UNTIL YOU MATCH THREE", "IF YOU MATCH THREE 'X'S, YOU LOSE", "IF YOU MATCH THREE 'Y'S, YOU LOSE" and "IF YOU MATCH THREE VALUES, YOU WIN THE MATCHED VALUE" may be provided to the player visually, or through suitable audio or audiovisual displays.

In operation of the play of this primary game, the gaming system enables a player to pick selections 148*a* to 148*o* until three matching selections are revealed. In this embodiment, since the gaming system employs predetermined game outcomes, regardless of which selections the player picks, the gaming system will cause the three player picked matching selections to correspond to the selected predetermined game outcome. That is, as seen in FIG. 6B, since the selected predetermined game outcome is a losing game outcome having a game presentation component of three 'X' symbols, the gaming system will ensure that the three matching player picked selections will result in a losing game outcome of three 'X' symbols.

Figure 6B:
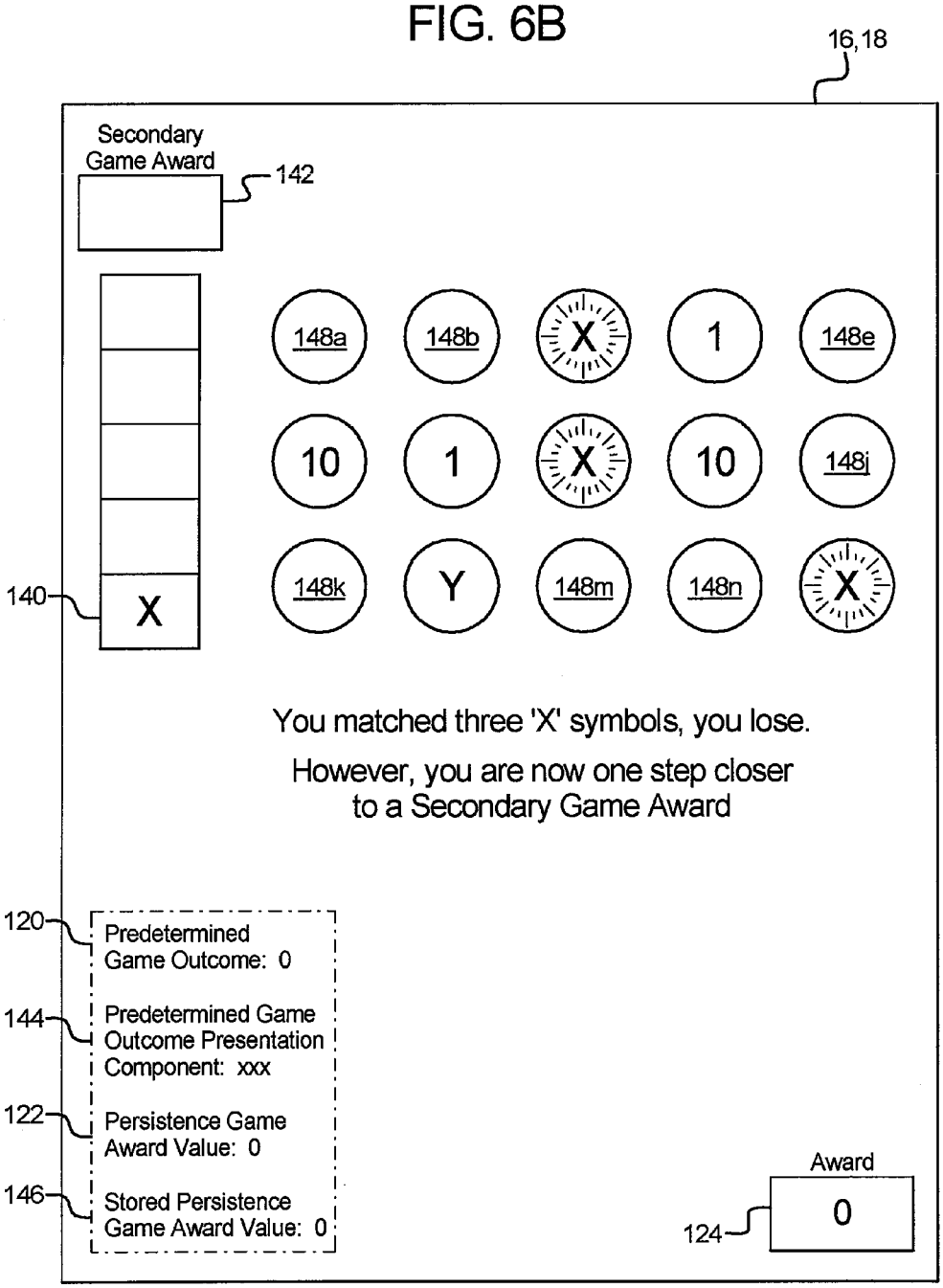

For example, as seen in FIGS. 6A and 6B, since a selected predetermined game outcome is associated with a lose game outcome component (which is not actually displayed to the player but is displayed in FIGS. 6A and 6B for illustration purposes only), the gaming system will cause the three player picked matching selections to reveal three 'X' symbols which correspond to the selected predetermined losing game outcome. It should be appreciated that in one embodiment, the selected predetermined game outcome is associated with each symbol or element displayed to the player as part of the game presentation component. For example, as seen in FIG. 6B, the selected predetermined game outcome is associated with the symbols or elements of Y-1-X-10-10-X-1-X which are displayed to the player as part of the game presentation component. In this example, regardless of which selections the player picks, the gaming system displays the "Y" symbol as the symbol associated with the first picked selection, the value of "1" as the symbol associated with the second picked selection and so on. It should be appreciated that in this example, if the gaming system needs to assure a Y-Y-Y losing symbol combination (to reset the accumulation meter as described herein or to cause the accumulation meter to continue incrementing as described herein), the gaming system is configured to swap the X symbols with Y symbols and proceed as described above. In one embodiment, after the symbols associated with each of the player picked selections have been displayed, the gaming system randomly associates symbols to display as associated with the unpicked selections. In another embodiment, the symbols to display as associated with the unpicked selections are included as part of the game presentation component of the selected predetermined game outcome.

As further seen in FIG. 6B, the losing game outcome causes an increase in the retreating accumulation meter and thus an "X" symbol representative of this type of losing game outcome is displayed in the first step or level of the accumulation meter. Appropriate messages such as "YOU MATCHED THREE 'X' SYMBOLS, YOU LOSE" and "HOWEVER, YOU ARE NOW ONE STEP CLOSER TO A SECONDARY GAME AWARD" may be provided to the player visually, or through suitable audio or audiovisual displays.

Referring back to FIG. 5A, if the gaming system determines that the game presentation component of the selected predetermined game outcome would cause the accumulation meter to reach the threshold amount, the gaming system modifies the game presentation component of the selected predetermined game outcome to prevent the accumulation meter from reaching the threshold amount as indicated in block 212. Following such a modification of the game presentation outcome of the selected predetermined game outcome, as indicated in block 214, the gaming system: (i) provides the game outcome component of the selected predetermined game outcome, (ii) displays the modified game presentation component and (iii) and resets the progress of the accumulation meter.

Figure 6C:
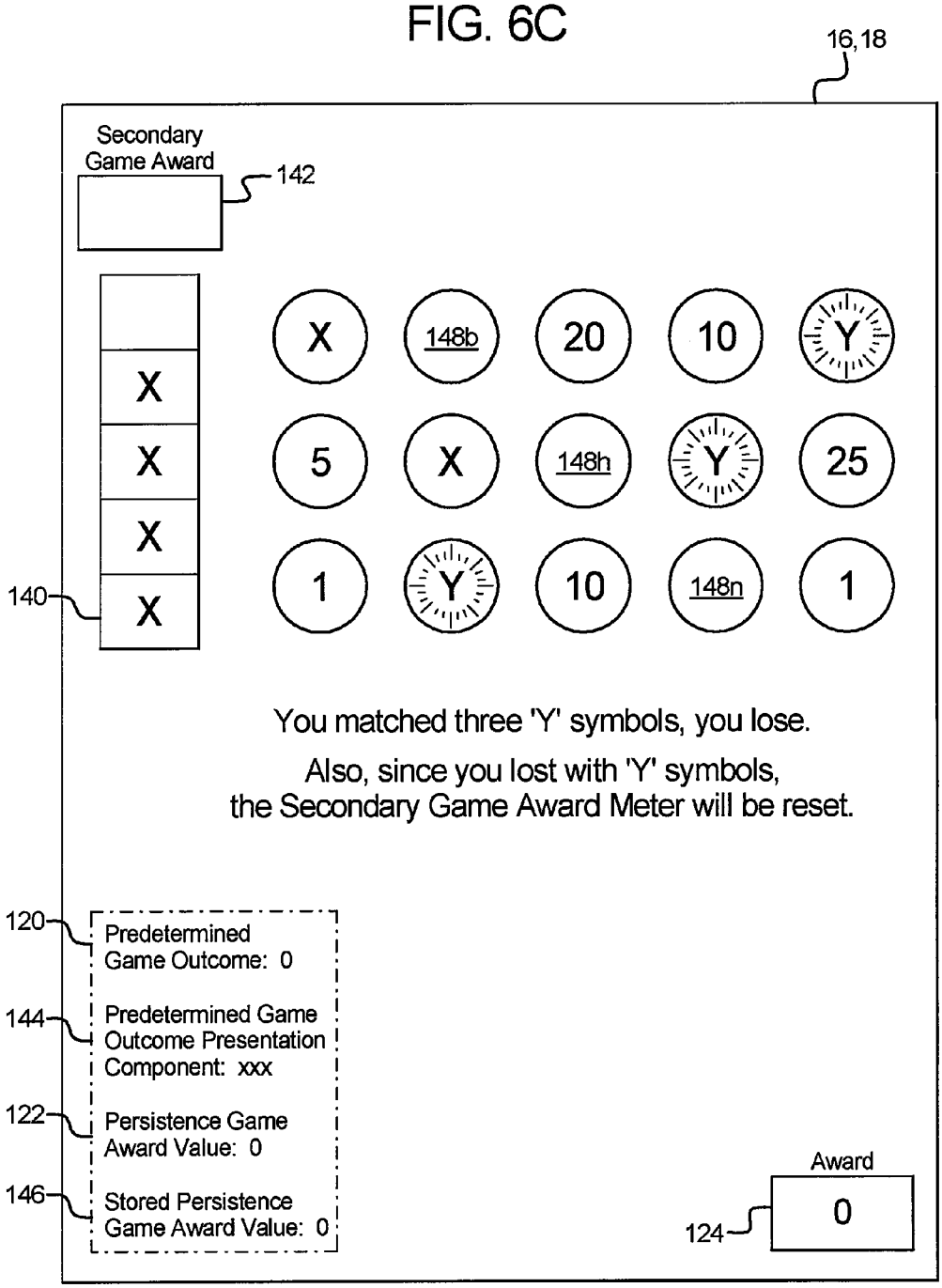

For example, FIG. 6C illustrates a subsequent point in time after which the retreating accumulation meter has previously been incremented three additional times with a first type of losing game outcome (i.e., the four X symbols displayed in the first four steps or levels of the accumulation meter) and is currently one increase away from reaching the threshold amount. In this example, if the selected predetermined game outcome has a game presentation component of the first type of losing game outcome (e.g., three matching X symbols), since no persistence game award value is available to be provided to the player in the persistence secondary game (i.e., the selected predetermined game outcome does not have a persistent game payout amount and no persistence game award value is previously stored), the gaming system must modify the game presentation component of the selected predetermined game outcome. Accordingly, as seen in FIG. 6C, the gaming system modifies the three matching X symbols game presentation component of the selected predetermined game outcome 146 to a second type of game presentation component for a losing game outcome (i.e., three matching Y symbols) to prevent the retreating accumulation meter from reaching the threshold. Such a modification causes the retreating accumulation meter to retreat to a designated amount, such as a reset amount. Appropriate messages such as "YOU MATCHED THREE 'Y' SYMBOLS, YOU LOSE" and "ALSO, SINCE YOU LOST WITH 'Y' SYMBOLS, THE SECONDARY GAME AWARD METER WILL BE RESET" may be provided to the player visually, or through suitable audio or audiovisual displays.

Referring back to FIG. 5A, if the gaming system determines that no persistence game award value is stored and the selected predetermined game outcome includes a persistence game award value, the gaming system stores the persistence game award value of the selected predetermined game outcome as indicated in block 216. Such a stored persistence game award value will be subsequently provided to a player in association with the play of the persistence secondary game.

After storing the persistence game award value of the selected predetermined game outcome, the gaming system determines if the game presentation component of the selected predetermined game outcome causes the accumulation meter to increment as indicated in diamond 218. That is, the gaming system determines if the game presentation component of the selected predetermined game outcome affects the retreating accumulation meter of the persistence secondary game by either causing the retreating accumulation meter to increment or causing the retreating accumulation meter to reset and then increment. If the game presentation component of the selected predetermined game outcome does not cause the accumulation meter to increment, as indicated in block 220, the gaming system: (i) provides the game outcome component of the selected predetermined game outcome, (ii) displays the game presentation component of the selected predetermined game outcome, and (iii) does not provide the stored persistence game award value.

Figure 6D:
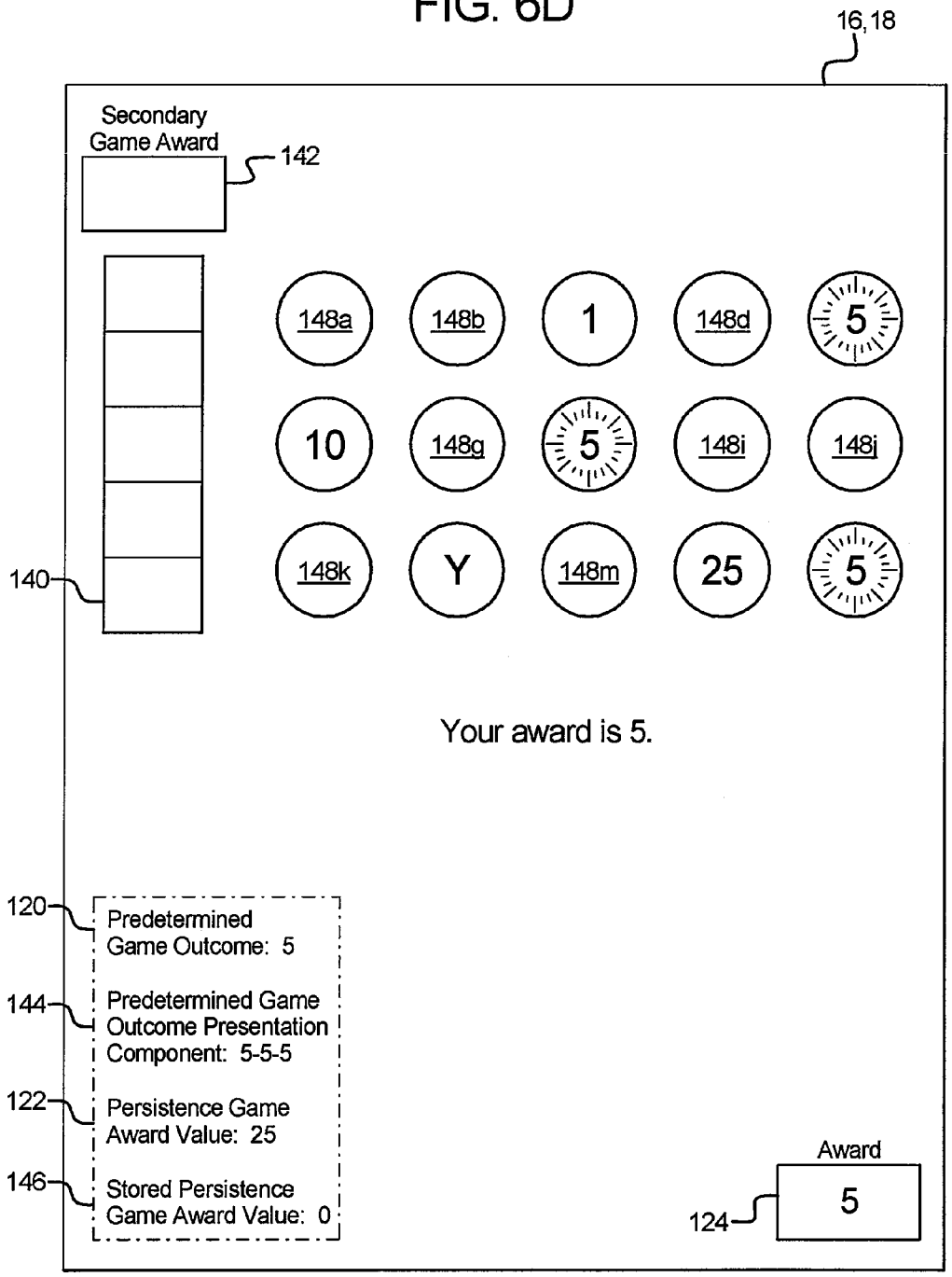

For example, as seen in FIG. 6D, if no persistence game award value is previously stored and the selected predetermined game outcome 120 includes a persistence game award value 122 the gaming system stores the persistence game award value of the selected predetermined game outcome. This stored persistence game award value will be the persistence game award ultimately provided to a player in association with the play of the persistence secondary game. That is, the selected persistence game award value will be banked to be subsequently provided to either the player playing the gaming device when the predetermined game outcome having the persistence game award value was selected or to another player subsequently playing that gaming device.

It should be appreciated that in one embodiment where each gaming device is associated with a separate persistence game, the player that is ultimately provided the persistence game award value may be: (i) the same player that was playing the gaming device when the predetermined game outcome having the persistence game award value was first selected in association of a first play of that gaming device, or (ii) another player that was subsequently playing the gaming device when the gaming system determined to provide the persistence game award value to the current player of the gaming device. It should be further appreciated that in another embodiment where a plurality of gaming devices are each associated with a community or multi-player persistence game, the player that is ultimately provided the persistence game award value may be: (i) a player that was playing a first gaming device when the predetermined game outcome having the persistence game award value was selected in association with a play of that first gaming device, (ii) another player that was playing a second gaming device when the predetermined game outcome having the persistence game award value was selected in association with the play of the first gaming device, (iii) another player that was subsequently playing the first gaming device when the gaming system determined to provide the persistence game award value to the current player of the first gaming device, or (iv) another player that was subsequently playing the second gaming device when the gaming system determined to provide the persistence game award value to the current player of the second gaming device.

As also seen in FIG. 6D, after determining that the game presentation component of the selected predetermined game outcome will not cause the accumulation meter 140 to increment, the gaming system enables the player to pick a plurality of selections wherein regardless of which selections the player picks, the gaming system will: (i) provide the win $5 game outcome component of the selected predetermined game outcome (as indicated in the award display 124), (ii) display the game presentation component of the selected predetermined game outcome (as indicated by the three matching values of five), and (iii) not provide the stored persistence game award value of $25. Appropriate messages such as "YOUR AWARD IS 5" may be provided to the player visually, or through suitable audio or audiovisual displays.

On the other hand, referring back to FIG. 5A, if the game presentation component of the selected predetermined game outcome causes the accumulation meter to increment, the gaming system determines if the retreating accumulation meter is current at a reset amount as indicated in diamond 222. If the retreating accumulation meter is currently at the reset amount (i.e., the retreating accumulation meter has not been previously incremented in association with a play of a primary game), the gaming system flags the game presentation component of the selected predetermined game outcome as indicated in block 224. For example, if the accumulation meter is currently at a reset amount and the game presentation component of the selected predetermined game outcome is a first type of losing game presentation (which will cause the accumulation meter to increase), the gaming system will flag this first type of losing game presentation. As described below, such flagging is utilized by the gaming system to ensure that subsequent changes to the accumulation meter will cause the accumulation meter to increase and not reset. Such controlled increasing of the accumulation meter provides that the stored persistence game award value is provided to the player in a timely fashion and preferably before each of the predetermined game outcomes of a set of predetermination game outcome have been flagged as unavailable to be provided again.

On the other hand, if the retreating accumulation meter is not currently at the reset amount (i.e., the retreating accumulation meter has been previously incremented in association with a play of a primary game), the gaming system flags the game presentation component associated with the currently incremented accumulation meter as indicated in block 226. That is, to ensure that subsequent changes to the accumulation meter will cause the accumulation meter to increase and not reset, the gaming system flags, caches or otherwise stores the current type of losing game presentation which has caused the accumulation to previously increment such that any subsequent game presentation displayed to the player will be the same type of losing game presentation to cause the accumulation meter to increase. Such controlled increasing of the accumulation meter provides that the stored persistence game award value is provided to the player in a timely fashion and preferably before each of the predetermined game outcomes of a set of predetermination game outcome have been flagged. For example, if the currently incremented accumulation meter has previously by incremented by a first type of losing game outcome, the gaming system will flag this first type of losing game presentation for subsequent use.

Following flagging the game presentation component of the selected predetermined game outcome or flagging the current type of losing game presentation which has caused the accumulation to previously increment, the gaming system: (i) displays the game presentation component of the selected predetermined game outcome, and (ii) increments the retreating accumulation meter as indicated in block 228 of FIG. 5B. The gaming system then determines if the retreating accumulation meter has reached a threshold amount as indicated in diamond 230. If the retreating accumulation meter has reached the threshold amount, as indicated in block 232, the gaming system: (i) provides the game outcome component of the selected predetermined game outcome, and (ii) provides the stored persistence game award value. On the other hand, if the retreating accumulation meter has not reached the threshold amount, as indicated in block 234, the gaming system: (i) provides the game outcome component of the selected predetermined game outcome, and (ii) does not provide the stored persistence game award value.

Referring back to diamond 204 of FIG. 5A, if a persistence game award value is previously stored, the gaming system determines if the selected predetermined game outcome includes a persistence game award value as indicated in diamond 236. If the selected predetermined game outcome includes a persistence game award value, the gaming system modifies the game presentation component of the selected predetermined game outcome to account for providing the persistence game award payout of the selected predetermined game outcome as a primary game award as indicated in block 238. Following such a modification, as indicated in block 240, the gaming system: (i) provides the game outcome component and the persistence game award value of the selected predetermined game outcome as a primary game award and (ii) displays the modified game presentation component. That is, if a persistence game award value is previously stored and the gaming system is attempting to provide this stored persistence game award value to a player via the ongoing persistence game, rather than having a plurality of persistence game award values stored (which would require a plurality of plays of the primary game), the gaming system will combine the selected persistence game award value with any primary game payout amount of the selected predetermined game outcome and provide this combined amount to a player as the primary game outcome.

Figure 6E:
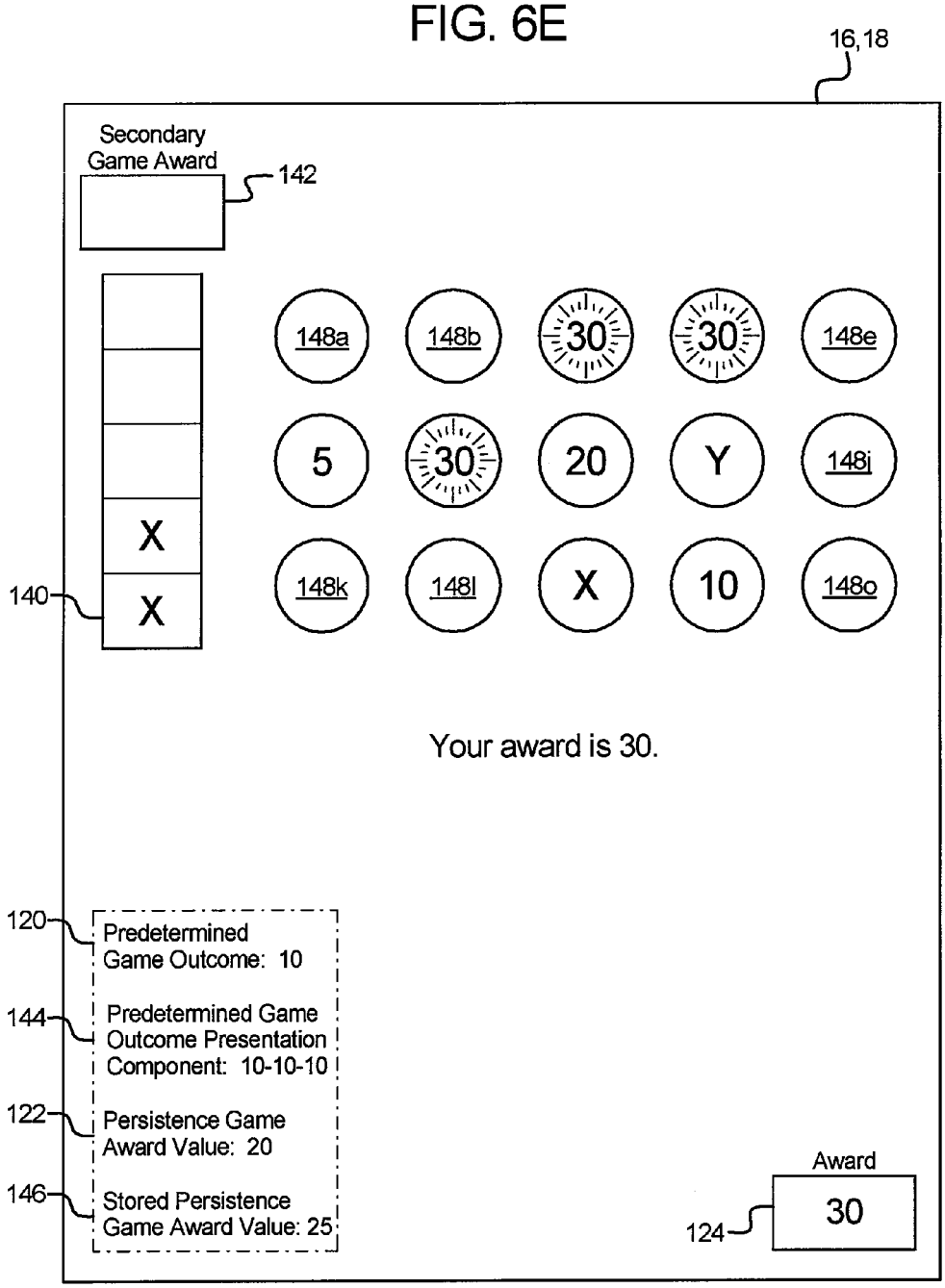

For example, as seen in FIG. 6E, if a selected predetermined game outcome has a win $10 game component and a persistence game award value of $20 and a persistence game award value of $25 is previously stored in association with a previously selected predetermined game outcome, the gaming system combines the win $10 game component and the persistence game award value of $20 of the selected predetermined game outcome to provide the player a primary game outcome of $30. In this example, rather than causing the first three matching values the player selects to be values of 10, the gaming system modifies the primary game payout such that the first three matching values the player selects to be the values of 30. Appropriate messages such as "YOUR AWARD IS 30" may be provided to the player visually, or through suitable audio or audiovisual displays.

On the other hand, if the selected predetermined game outcome does not include a persistence game award value, the gaming system determines if the game presentation component of the selected predetermined game outcome would cause the accumulation meter to increment as indicated in diamond 242 of FIG. 5B. That is, the gaming system determines if the game presentation component of the selected predetermined game outcome affects the retreating accumulation meter of the persistence secondary game by either causing the retreating accumulation meter to increment or causing the retreating accumulation meter to reset and then increment. If the game presentation component of the selected predetermined game outcome would not cause the accumulation meter to increment, as indicated in block 244, the gaming system: (i) provides the game outcome component of the selected predetermined game outcome, (ii) displays the game presentation component of the selected predetermined game outcome and (iii) does not provide the stored persistence game award value.

If the game presentation component of the selected predetermined game outcome would cause the accumulation meter to increment, the gaming system determines if the game presentation component of the selected predetermined game outcome is the same as the flagged game presentation component as indicated in diamond 246. If the game presentation component of the selected predetermined game outcome is not the same as the flagged game presentation component, the gaming system modifies the game presentation component of the selected predetermined game outcome to be the same as the flagged game presentation component as indicated in block 248. That is, to prevent the accumulation meter from decreasing (and thus to prevent any delay in providing the stored persistence game award value to a player), if the game presentation component of the selected predetermined game outcome is different from the flagged game presentation component, the gaming system modifies the game presentation component to the flagged game presentation component. Such modifications ensure that the persistence game award value is provided to the player after one or more subsequent plays of the primary game. That is, to provide that a predetermined persistence game award value is provided to a player upon the completion of one or more subsequent plays of the primary game, the central determination gaming system disclosed herein controls one or more aspects of such subsequent primary games.

Following the modification of the game presentation component of the selected predetermined game outcome, the gaming system: (i) displays the modified game presentation component, and (ii) increments the retreating accumulation meter as indicated in block 250. The gaming system then determines if the retreating accumulation meter has reached a threshold amount as described above and indicated in diamond 230. If the retreating accumulation meter has reached the threshold amount, as indicated in block 232, the gaming system: (i) provides the game outcome component of the selected predetermined game outcome, and (ii) provides the stored persistence game award value. On the other hand, if the retreating accumulation meter has not reached the threshold amount, as indicated in block 234, the gaming system: (i) provides the game outcome component of the selected predetermined game outcome, and (ii) does not provide the stored persistence game award value.

On the other hand, if the game presentation component of the selected predetermined game outcome is the same as the flagged game presentation component, as described above and indicated in block 228, the gaming system: (i) displays the game presentation component of the selected predetermined game outcome, and (ii) increments the retreating accumulation meter. The gaming system then determines if the retreating accumulation meter has reached a threshold amount as indicated in diamond 230. If the retreating accumulation meter has reached the threshold amount, as indicated in block 232, the gaming system: (i) provides the game outcome component of the selected predetermined game outcome, and (ii) provides the stored persistence game award value. On the other hand, if the retreating accumulation meter has not reached the threshold amount, as indicated in block 234, the gaming system: (i) provides the game outcome component of the selected predetermined game outcome, and (ii) does not provide the stored persistence game award value.

In one embodiment, only predetermined game outcomes with losing game outcome components include persistence game award values. In another embodiment, only predetermined game outcomes with winning game outcome components include persistence game award values. As described above, since the persistence game award value may not be provided to a player for a quantity or number of subsequent plays of the primary game, providing that only predetermined game outcomes with winning game outcome components include persistence game award values increases the chances that a player will have enough credits to continue wagering on plays of the primary game until the persistence game award value is provided. For example, if a five step or level accumulation meter has previously been incremented one step or level and a predetermined game outcome having a persistence game award value is selected, the gaming system provides the player a primary game award of $10 (thus guaranteeing that the player will not run out of money while incrementing the accumulation meter). In this example, for every subsequent losing game outcome that is selected, the gaming system will display an appropriate losing game presentation component to cause the accumulation meter to increment. Accordingly, even if the next four predetermined game outcomes that are selected are all losing game outcomes, the player will be guaranteed to have at least enough credits remaining to pay for the play of the primary game that provides a losing game outcome that advances the accumulation meter to the threshold to cause the stored persistence game award value to be provided to the player.

In one above described embodiment, the gaming system may modify the game outcome provided to the player based on the status of the accumulation meter. In another embodiment, the losing predetermined game outcomes each include a plurality of different game outcome presentations which may be displayed to the player based on the status of the accumulation meter. In one such embodiment, each selected losing predetermined game outcome includes the full information to display either type of losing game outcome presentation. In another embodiment, each selected losing predetermined game outcome includes a random number generating seed, wherein the first cycle of the random number generating seed in a random number generating algorithm produces the default losing game outcome presentation and the second cycle of the random number generating seed in the random number generating algorithm produces a modified losing game outcome presentation. In another embodiment, each selected losing predetermined game outcome includes an index that indicates which 1 of N pre-stored alternate results to display to the player. In another embodiment, the gaming system randomly selects one of the N pre-stored alternate results to display for each selected losing predetermined game outcome. In another embodiment, the gaming system generates an alternate outcome in real time and/or pre-cached outcome for each selected losing predetermined game outcome.

In the embodiment described above in FIGS. 5A and 5B, the gaming system stores or banks one persistence game award value at a time. In one such embodiment, since the persistence secondary game requires a plurality of plays of the primary game to complete and the predetermined game outcomes are selected from a pool which includes a limited quantity of predetermined game outcomes, to ensure that the pool of predetermined game outcomes is not retired with a plurality of persistence game award values stored, the gaming system only stores one persistence game award value at a time. In another embodiment, the gaming system stores a plurality of persistence game award values at a time. In one such embodiment, if a selected predetermined game outcome includes a persistence game award value and a persistence game award value is previously stored, the gaming system combines such persistence game award value to form a modified persistence game award value for the current play of the persistence game. In another such embodiment, if a first persistence game award value is previously stored and a selected predetermined game outcome includes a second persistence game award value, the gaming system provides that the first play of the persistence secondary game will be for the first stored persistence game award value and the second play of the persistence secondary game will be for the second stored persistence game award value.

In one embodiment, if a predetermined game outcome having a persistence game award value is selected from a set or pool of predetermined game outcomes which is empty or relatively empty, the gaming system combines any predetermined game outcome component of the selected predetermined game outcome and the persistence game award value to form a modified primary game award which is provided to the player. That is, if a predetermined game outcome having a persistence game award value is selected but the quantity of predetermined game outcomes remaining in the set or pool of predetermined game outcomes is less than the number of levels or steps of the accumulation meter that must be increased to reach the accumulation meter threshold and provide the player the persistence game award value, the gaming system provides this persistence game award value to the player via the primary game. In one such embodiment, if a predetermined game outcome having a persistence game award value is selected from a set or pool of predetermined game outcomes which is empty or relatively empty, the gaming system awards the player his wager back so as to not receive any more than the total expected incoming wagers. In one such embodiment, the return of the player's wagers is displayed to the player as the non-acceptance of the player's wager. In another such embodiment, the return of the player's wager is displayed as a winning outcome exactly equal to the player's wager. In these embodiments, the gaming system will then clear the queued persistence game award value in case a new pool of predetermined game outcome is initiated. In another such embodiment, if a predetermined game outcome having a persistence game award value is selected from a set or pool of predetermined game outcomes which is empty or relatively empty, the gaming system does not provide the persistence game award value to any player. It should be appreciated that the amounts not provided to any player represent a fraction of the awards provided from the pool of predetermined game outcome and thus not providing such amounts will not materially affect the overall return to player of such a pool of predetermined game outcomes. In one such embodiment, the gaming system is configured to report to the casino operator the amount of any persistence game award values not provided to any players when a pool of predetermined game outcomes is depleted and/or retired. In another such embodiment, any persistence game award values not provided to any players when a pool of predetermined game outcomes is depleted and/or retired are transferred to fund the payout other game awards and/or to fund marketing promotion awards.

As described above, in one embodiment of the gaming system disclosed herein, although a predetermined game outcome selected in association with a first play of a primary game includes a persistence game award value, that persistence game award value may not be provided to the player in association with the first play of a primary game (i.e., simultaneously with the game outcome component of the predetermined game outcome that is selected in association with the first play of the primary game), but rather may be provided to another player in association with a subsequent play of a primary game.

In another embodiment, the gaming system provides that the same player that is provided the predetermined game outcome having the persistence game award value is provided the persistence game award value. In one such embodiment, if a persistence game award value is stored for the player, that player will be provided an opportunity to win the stored persistence game award value when the player cashes out or the player's credit balance reaches a designated amount, such as zero. In another such embodiment, if a persistence game award value is stored for the player, that player will automatically be provided an opportunity to win the stored persistence game award value when the player cashes out. In another such embodiment, the gaming system enables the player to try to play off accumulation meter values. In this embodiment, if a persistence game award value is stored for the player, that player will be provided this persistence game award value with this attempt. For example, as each persistence game award value is stored, that persistence game award value is used to fill (or is otherwise associated with) a slice of a wheel. In this example, the gaming system enables the player to selectively cause a spin of the wheel regardless of whether each of the slices of the wheel full. In this embodiment, if the spun wheel lands on an unfilled slice of the wheel (i.e., a slice not associated with a stored persistence game award value), no persistence game award value is provided to the player. On the other hand, if the spun wheel lands on a filled slice of the wheel (i.e., a slice associated with a stored persistence game award value), that persistence game award value is provided to the player and the slices of the wheel are cleared.

In another embodiment, if a persistence game award value is stored in association with a partially incremented accumulation meter, for one or more subsequent plays of the primary game, the gaming system will randomly increment the retreating accumulation meter. In this embodiment, if the gaming system randomly determines to increment the accumulation meter (and randomly determines how much to increment the accumulation meter) and such an increment causes the accumulation meter to reach the designated threshold amount, the gaming system provides a player the stored persistence game award value associated with the accumulation meter. For example, if the accumulation meter is three levels or steps away from the threshold level and the gaming system randomly determines an amount of levels or steps to increment the accumulation meter. In this example, if the gaming system randomly determines to increment the accumulation meter by three levels (i.e., to the threshold level), the gaming system provides the stored persistence game award value associated with the accumulation meter to the player.

In one embodiment wherein the gaming system randomly determines whether to increment the accumulation meter, as the accumulation meter advances toward the threshold level, the probability of the gaming system randomly incrementing the accumulation meter remains unchanged regardless of the status of the accumulation meter. In one embodiment wherein the gaming system randomly determines whether to increment the accumulation meter, as the accumulation meter advances toward the threshold level, the probability of the gaming system randomly incrementing the accumulation meter changes based on the status of the accumulation meter. In one such embodiment, the closer the accumulation meter advances toward the threshold level, the lower the probability that the gaming system will randomly increment the accumulation meter. This embodiment provides that initial advancements of the accumulation meter, on average, come quickly while later advancements of the accumulation meter take longer. In another such embodiment, the closer the accumulation meter advances toward the threshold level, the greater the probability that the gaming system will randomly increment the accumulation meter. This embodiment provides that initial advancements of the accumulation meter, on average, take longer while later advancements of the accumulation meter come quickly. In another embodiment, the gaming system utilizes the rapid accumulation meter advancement function described above to increment the retreating accumulation meter. In one such embodiment, while certain outcomes advance the accumulator one step, another type of outcome advances the accumulator two or more steps. In different embodiments, the amount the accumulator is advanced with the rapid advancement feature is a static number or a randomly determined number.

In one embodiment, if the last predetermined game outcome in a set or pool of predetermined game outcomes is selected and at least one persistence game award value is stored, the gaming system combines any predetermined game outcome component of the selected predetermined game outcome and any stored persistence game award values to form a modified primary game award which is provided to the player. In another embodiment, if the last predetermined game outcome in a set or pool of predetermined game outcomes is selected and at least one persistence game award value is stored, the gaming system causes the accumulation meter to automatically increase to the threshold amount such that any stored persistence game award values are provided to the player.

Maintaining Blocks of Predetermined Game Outcomes

In another embodiment of the gaming system disclosed herein, blocks or packs of predetermined game outcomes in a set of predetermined game outcomes are kept together. For example, when a gaming device first requests a predetermined game outcome from the central server, the gaming system communicates a known block of predetermined game outcomes, such as one-thousand predetermined game outcomes, to the requesting gaming device. The gaming device then presents the player with the first predetermined game outcome specified in the communicated block and caches the remaining predetermined game outcome for future presentation. In such a system, all blocks of predetermined game outcomes are guaranteed to play in order (if at all) on one of the connected gaming devices.

In one embodiment wherein a block or pack of predetermined game outcomes are kept together, the gaming system disclosed herein utilizes a special algorithm in generating the set of predetermined game outcomes to assure a specific number of a series of predetermined game outcomes will lead to the player receiving an accumulation meter-based award. For such a solution, the arrangements of predetermined game outcomes within a static block of predetermined game outcomes are guaranteed to have an empty accumulation meter at the start and the end of the block of predetermined game outcomes. Therefore, any block of predetermined game outcomes can be communicated to any gaming device in the gaming system.

In one such embodiment, to provide that a static block of predetermined game outcomes will have an empty accumulation meter at the start and the end of the block of predetermined game outcomes, the gaming system provides that a block of predetermined game outcomes includes between 1 and N predetermined game outcomes, where N is a static integer. In this embodiment, when a set of predetermined game outcomes is generated, the packs of predetermined game outcomes are shuffled and not the individual predetermined game outcomes.

Figure 7:
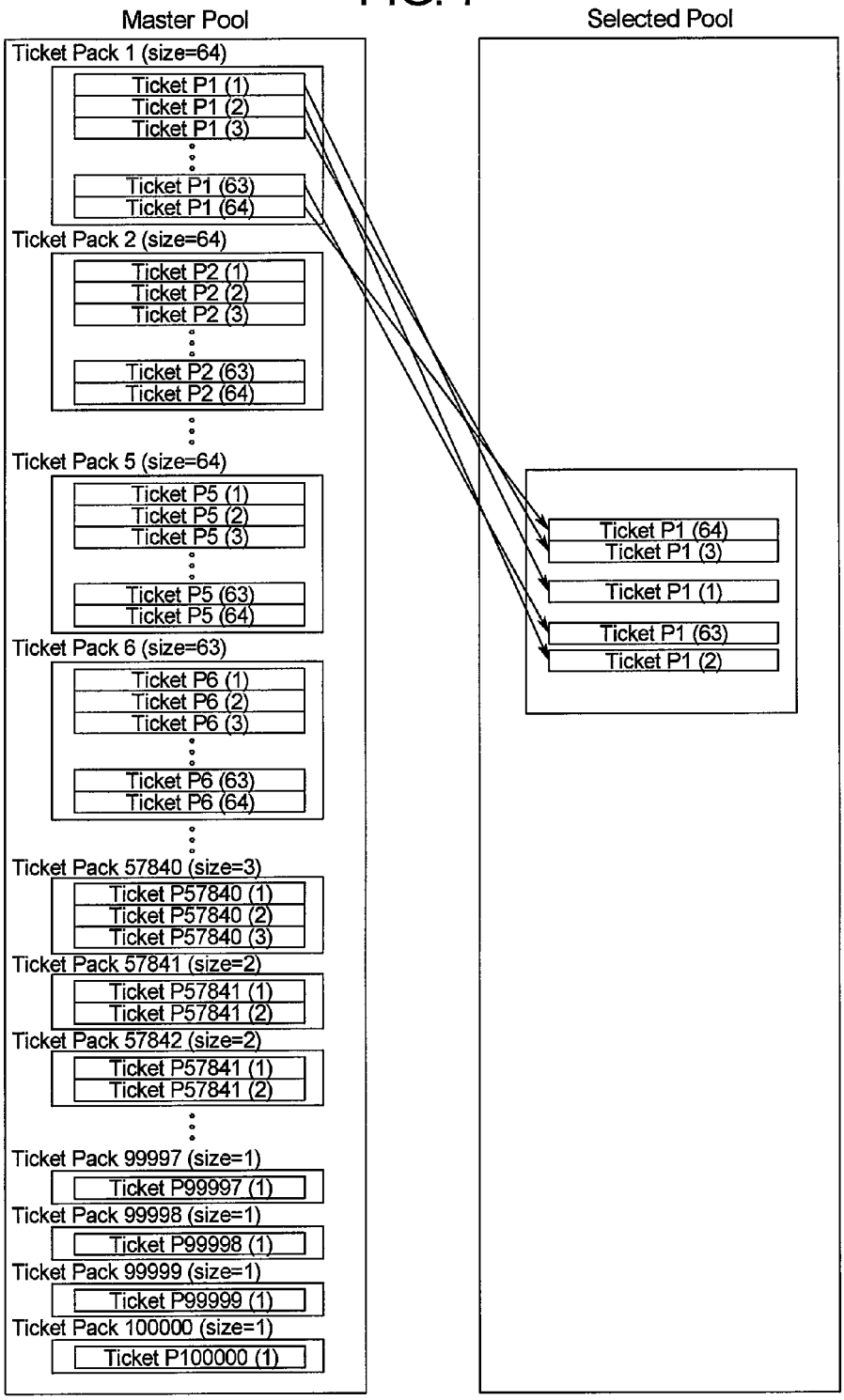
FIG. 7 is a schematic diagram illustrating a master pool of predetermined game outcomes includes a plurality of maintained blocks of predetermined game outcomes.

In one embodiment wherein a block of predetermined game outcomes are maintained such that the accumulation meter will be empty at the start and the end of the use of the block of predetermined game outcomes, as seen in FIG. 7, all the predetermined game outcomes in a block are shuffled. In different embodiments, none of the predetermined game outcomes in a block are shuffled, only the interior predetermined game outcomes in a block are shuffled or the predetermined game outcomes in a block are always in the same order. In one such embodiment, each block in the master pool of predetermined game outcomes will be randomly assigned to a location large enough to hold the pack intact, preferably in order of largest blocks to smallest ones. Based on the gaming system requirements, this process may also involve checking to make sure that no block of predetermined game outcomes crosses a cache-block barrier (i.e., a minimum amount of data or information transferred per request for a block of predetermined game outcomes). In the case where previous blocks of game outcomes have been placed such that not all of the remaining blocks can be placed intact, there are multiple ways to overcome this. In one version, the currently accessed block of predetermined game outcome is cleared and the entire process is attempted again from the start. In another variation, the blocks placed in the instantiated pool surrounding the largest free area are shifted to free up the required contiguous space.

In one embodiment, since the block of predetermined game outcomes will have an empty accumulation meter at the start and the end of the block of predetermined game outcomes, when a gaming device requests a predetermined game outcome, the gaming system communicates a block of predetermined game outcomes to the gaming device. In this embodiment, the gaming device selects predetermined game outcomes from this communicated block of predetermined game outcomes such that when each of the predetermined game outcomes have been provided for plays of the primary game, the accumulation meter is empty and all persistence game award values of the block of predetermined game outcomes have been provided to players.

In another embodiment, since the block of predetermined game outcomes will have an empty accumulation meter at the start and the end of the block of predetermined game outcomes, when a gaming device requests a predetermined game outcome, the gaming system associates a block of predetermined game outcomes with that gaming device. In this embodiment, each subsequent time the gaming device requests another predetermined game outcome, the gaming system will select a predetermined game outcome from the block of predetermined game outcomes associated with that gaming device such that when each of the predetermined game outcomes have been provided for plays of the primary game, the accumulation meter is empty and all persistence game award values of the block of predetermined game outcomes have been provided to players.

In another embodiment, the gaming system provides that any time there is a non-advancing change in the accumulation meter (i.e., a change in the accumulation other than advancing the accumulation meter), the gaming system resets the accumulation meter to one increment. In this embodiment, the arrangements of predetermined game outcomes within a static block of predetermined game outcomes provides that each time a new block of predetermined game outcomes is accessed, the current status of the accumulation meter will be the same (i.e., one increment). Therefore, as described above, any block of predetermined game outcomes can be communicated to any gaming device in the gaming system.

In alternative embodiment, the gaming system enables the accumulator to increase naturally via the random nature of ticket shuffling. In most cases, when an accumulator is about to reach a threshold amount, the gaming device obtains an award value from a separate pool of predetermined game outcomes from the central server, the gaming device then displays the accumulator fill and provides this award vale to a player. For a given ticket pool, there are a max number of such awards available. If all of the accumulator awards have been dispersed, the central server indicates to all gaming devices that no more accumulator fills are allowed, and the gaming device controls the specific losing outcome as described above to assure no more winners.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention is claimed as follows:

1. A gaming system comprising:

a housing;

a plurality of input devices supported by the housing, said plurality of input devices including:

(i) an acceptor, and (ii) a cashout device;

at least one display device supported by the housing;

at least one processor; and at least one memory device which stores a plurality of instructions, which when executed by the at least one processor, cause the at least one processor to operate with the at least one display device and the plurality of input devices to:

(a) if a physical item is received via the acceptor, establish a credit balance based, at least in part, on a monetary value associated with the received physical item, wherein said physical item is selected from the group consisting of: a ticket associated with the monetary value and a unit of currency;

(b) enable a first player to place a wager on a first play of a primary game;

(c) cause one of a plurality of predetermined game outcomes to be selected for the first play of the primary game, each of the plurality of predetermined game outcomes being determined prior to the first play of the primary game, each of said predetermined game outcomes including a predetermined primary game outcome value and at least one of said predetermined game outcomes including a predetermined persistence game award value;

(d) if the selected predetermined game outcome includes said predetermined persistence game award value:

(i) determine whether to provide the predetermined persistence game award value to the first player for a persistence game;

(ii) if the determination is to provide the predetermined persistence game award value to the first player:

(A) in association with the first play of the primary game:

(I) display a symbol combination associated with the predetermined primary game outcome value of the selected predetermined game outcome, (II) display a primary game award associated with the displayed symbol combination, said displayed primary game award corresponding to the predetermined primary game outcome value, and (III) provide the predetermined primary game outcome value of the selected predetermined game outcome to the first player, and (B) in association with the first play of the primary game, display and provide the predetermined persistence game award value to the first player for the persistence game; and (iii) if the determination is not to provide the predetermined persistence game award value to the first player, (A) in association with the first play of the primary game:

(I) display a symbol combination associated with the predetermined primary game outcome value of the selected predetermined game outcome, (II) display a primary game award associated with the displayed symbol combination, said displayed primary game award corresponding to the predetermined primary game outcome value, and (III) provide the predetermined primary game outcome value of the selected predetermined game outcome to the first player, and (B) store the predetermined persistence game award value until a determination occurs in association with a second, subsequent play of the primary game to display the predetermined persistence game award value to a second player and provide the predetermined persistence game award value to the second player; and (e) if a cashout input is received via the cashout device, cause an initiation of any payout associated with the credit balance.

2. The gaming system of claim 1, wherein the determination to provide the predetermined persistence game award value to the first player is based on a current status of an accumulation meter.

3. The gaming system of claim 1, wherein the determination to provide the predetermined persistence game award value to the first player is based on a determination of if any predetermined persistence game award values are previously stored.

4. The gaming system of claim 1, wherein the predetermined primary game outcome value is zero.

5. The gaming system of claim 1, wherein when executed by the at least one processor, the plurality of instructions cause the at least one processor to select said predetermined game outcome from the plurality of predetermined game outcomes.

6. The gaming system of claim 5, wherein the plurality of predetermined game outcomes are maintained as a block of predetermined game outcomes.

7. The gaming system of claim 1, wherein when executed by the at least one processor, the plurality of instructions cause the at least one processor to operate with the at least one memory device to store said predetermined game outcome.

8. The gaming system of claim 1, wherein when executed by the at least one processor, the plurality of instructions cause the at least one processor to receive said predetermined game outcome from a central controller.

9. A gaming system comprising:

a housing;

a plurality of input devices supported by the housing, said plurality of input devices including:

(i) an acceptor, and (ii)

a cashout device;

at least one display device supported by the housing;

at least one processor; and at least one memory device which stores a plurality of instructions, which when executed by the at least one processor, cause the at least one processor to operate with the at least one display device and the plurality of input devices to:

(a) if a physical item is received via the acceptor, establish a credit balance based, at least in part, on a monetary value associated with the received physical item, wherein said physical item is selected from the group consisting of: a ticket associated with the monetary value and a unit of currency;

(b) enable a player to place a wager on a play of a primary game;

(c) cause one of a plurality of predetermined game outcomes to be selected for the play of the primary game, each of the plurality of predetermined game outcomes being determined prior to the play of the primary game, each of said predetermined game outcomes including a predetermined primary game outcome value and at least one of said predetermined game outcomes including a predetermined persistence game award value;

(d) display a symbol combination associated with the predetermined primary game outcome value of the selected predetermined game outcome, (e) display a primary game award associated with the displayed symbol combination, said displayed primary game award corresponding to the predetermined primary game outcome value, (f) provide to the player the predetermined primary game outcome value of the selected predetermined game outcome;

(g) determine if the selected predetermined game outcome includes said predetermined persistence game award value;

(h) if the selected predetermined game outcome includes said predetermined persistence game award value:

(i) adjust a state of a persistence game, (ii) determine if the adjusted state of the persistence game is associated with a persistence game award event, and (iii) if the adjusted state of the persistence game is associated with the persistence game award event, display and provide the predetermined persistence game award value to the player for the persistence game; and (i) if a cashout input is received via the cashout device, cause an initiation of any payout associated with the credit balance.

10. The gaming system of claim 9, wherein if the selected predetermined game outcome includes said predetermined persistence game award value and the adjusted state of the persistence game is not associated with the persistence game award event, store the predetermined persistence game award value until an adjusted state of the persistence game is associated with the persistence game award event.

11. The gaming system of claim 9, wherein the determination of if the adjusted state of the persistence game is associated with the persistence game award event is based on a current status of an accumulation meter.

12. The gaming system of claim 9, wherein the determination of if the adjusted state of the persistence game is associated with the persistence game award event is based on a determination of if any predetermined persistence game award values are previously stored.

13. The gaming system of claim 9, wherein the selected predetermined primary game outcome value is zero.

14. A gaming system comprising:

a housing;

a plurality of input devices supported by the housing, said plurality of input devices including:

(i) an acceptor, and (ii)

a cashout device;

at least one display device supported by the housing;

at least one processor; and at least one memory device which stores a plurality of instructions, which when executed by the at least one processor, cause the at least one processor to operate with the at least one display device and the plurality of input devices to:

(a) if a physical item is received via the acceptor, establish a credit balance based, at least in part, on a monetary value associated with the received physical item, wherein said physical item is selected from the group consisting of: a ticket associated with the monetary value and a unit of currency;

(b) enable a player to place a wager on a play of a primary game;

(c) cause a predetermined game outcome to be selected, said selected predetermined game outcome being determined prior to the play of the primary game and said selected predetermined game outcome including a predetermined primary game outcome value;

(d) display a symbol combination associated with the predetermined primary game outcome value of the selected predetermined game outcome, (e) display a primary game award associated with the displayed symbol combination, said displayed primary game award corresponding to the predetermined primary game outcome value, (f) provide the predetermined primary game outcome value of the selected predetermined game outcome to the player for the play of the primary game;

(g) if the selected predetermined game outcome includes a predetermined persistence game award value:

(i) increase a non-retreating accumulation meter associated with a persistence secondary game, wherein said accumulation meter is increased based, at least in part, on the predetermined persistence game award value of the selected predetermined game outcome, (ii) if the increased accumulation meter has not reached a designated threshold amount:

(A) store the predetermined persistence game award value, and (B) repeat (b) to (g) at least once, and (iii) if the increased accumulation meter has reached the designated threshold amount:

(A) provide any stored predetermined persistence game award values to the player in association with the persistence secondary game, and (B) reset the accumulation meter; and (h) if a cashout input is received via the cashout device, cause an initiation of any payout associated with the credit balance.

15. The gaming system of claim 14, wherein the predetermined primary game outcome value is zero.

16. The gaming system of claim 14, wherein the predetermined primary game outcome value is greater than zero.

17. The gaming system of claim 14, wherein when executed by the at least one processor, the plurality of instructions cause the at least one processor to select said predetermined game outcome from a plurality of predetermined game outcomes.

18. The gaming system of claim 14, wherein when executed by the at least one processor, the plurality of instructions cause the at least one processor to operate with the at least one memory device to store said predetermined game outcome.

19. The gaming system of claim 14, wherein when executed by the at least one processor, the plurality of instructions cause the at least one processor to receive said predetermined game outcome from a central controller.

20. A gaming system comprising:

a housing;

a plurality of input devices supported by the housing, said plurality of input devices including:

(i) an acceptor, and (ii)

a cashout device;

at least one display device supported by the housing;

at least one processor; and at least one memory device which stores a plurality of instructions, which when executed by the at least one processor, cause the at least one processor to operate with the at least one display device and the plurality of input devices to:

(a) if a physical item is received via the acceptor, establish a credit balance based, at least in part, on a monetary value associated with the received physical item, wherein said physical item is selected from the group consisting of: a ticket associated with the monetary value and a unit of currency;

(b) enable a player to place a wager on a play of a primary game;

(c) cause a predetermined game outcome to be selected, said selected predetermined game outcome being determined prior to the play of the primary game and said selected predetermined game outcome including a predetermined primary game outcome value;

(d) if the selected predetermined game outcome includes a predetermined persistence game award value and another predetermined persistence game award value is stored in association with a persistence secondary game, display and provide a first primary game award to the player in association with the play of the primary game, the first primary game award including the predetermined primary game outcome value of the selected predetermined game outcome, and the predetermined persistence game award value of the selected predetermined game outcome;

(e) if no predetermined persistence game award values are stored in association with the persistence secondary game, if the selected predetermined game outcome does not include the predetermined persistence game award value, and if a game presentation component of the selected predetermined game outcome would cause a retreating accumulation meter to reach a threshold amount:

(i) modify the game presentation component of the selected predetermined game outcome to prevent the accumulation meter from reaching the threshold amount, (ii) display the modified game presentation component in association with the play of the primary game, and (iii) provide a second primary game award to the player in association with the play of the primary game, the second primary game award including the predetermined primary game outcome value of the selected predetermined game outcome;

(f) if no predetermined persistence game award values are stored in association with the persistence secondary game, if the selected predetermined game outcome includes the predetermined persistence game award value, and if the game presentation component of the selected predetermined game outcome will not cause the accumulation meter to increase:

(i) store the predetermined persistence game award value of the selected predetermined game outcome, and (ii) provide the second primary game award to the player in association with the play of the primary game;

(g) if another predetermined persistence game award value is stored in association with the persistence secondary game, if the selected predetermined game outcome does not include the predetermined persistence game award value, and if the game presentation component of the selected predetermined game outcome would cause the retreating accumulation meter to reset:

(i) modify the game presentation component of the selected predetermined game outcome to prevent the accumulation meter from resetting, (ii) display the modified game presentation component in association with the play of the primary game, and (iii) provide the second primary game award to the player in association with the play of the primary game; and (h) if a cashout input is received via the cashout device, cause an initiation of any payout associated with the credit balance.

21. The gaming system of claim 20, wherein when executed by the at least one processor, the plurality of instructions cause the at least one processor to increase the accumulation meter if a first designated game presentation component associated with the accumulation meter is displayed.

22. The gaming system of claim 21, wherein when executed by the at least one processor, the plurality of instructions cause the at least one processor to reset the accumulation meter if a second, designated game presentation component is displayed, wherein the second, designate game presentation component is different than the first designated game presentation component.

23. The gaming system of claim 20, wherein the predetermined primary game outcome value is zero.

24. The gaming system of claim 20, wherein the predetermined primary game outcome value is greater than zero.

25. The gaming system of claim 20, wherein when executed by the at least one processor, the plurality of instructions cause the at least one processor to select said predetermined game outcome from a plurality of predetermined game outcomes.

26. The gaming system of claim 20, wherein when executed by the at least one processor, the plurality of instructions cause the at least one processor to operate with the at least one memory device to store said predetermined game outcome.

27. The gaming system of claim 20, wherein when executed by the at least one processor, the plurality of instructions cause the at least one processor to receive said predetermined game outcome from a central controller.

* * * * *